US011566544B2

(12) United States Patent
Van Wingerden et al.

(10) Patent No.: US 11,566,544 B2
(45) Date of Patent: Jan. 31, 2023

(54) ROCKER ARM ASSEMBLY WITH LOST MOTION SPRING

(71) Applicant: Eaton Intelligent Power Limited, Dublin (IE)

(72) Inventors: Mark Van Wingerden, Battle Creek, MI (US); Douglas J. Nielsen, Marshall, MI (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/315,534

(22) Filed: May 10, 2021

(65) Prior Publication Data

US 2021/0262366 A1 Aug. 26, 2021

Related U.S. Application Data

(63) Continuation-in-part of application No. 17/018,008, filed on Sep. 11, 2020, which is a continuation-in-part (Continued)

(51) Int. Cl.

| | |
|---|---|
| ***F01L 1/18*** | (2006.01) |
| ***F01L 1/46*** | (2006.01) |
| *F01L 13/00* | (2006.01) |

(52) U.S. Cl.

CPC ..... *F01L 1/181* (2013.01); *F01L 1/46* (2013.01); *F01L 13/0005* (2013.01); *F01L 2001/186* (2013.01); *F01L 2001/467* (2013.01)

(58) Field of Classification Search

CPC . F01L 1/18; F01L 1/46; F01L 2810/02; F01L 2013/001; F01L 13/0005; F01L 2305/00; F01L 2001/467; F01L 2001/186; F01L 1/047; F01L 1/181; F01M 9/10; F01M 11/02

(Continued)

(56) References Cited

U.S. PATENT DOCUMENTS

| | | | |
|---|---|---|---|
| 5,655,488 | A | 8/1997 | Hampton et al. |
| 6,000,374 | A | 12/1999 | Cosma et al. |

(Continued)

FOREIGN PATENT DOCUMENTS

| | | | |
|---|---|---|---|
| CN | 101161998 | A | 4/2008 |
| CN | 103388504 | B | 3/2016 |

(Continued)

OTHER PUBLICATIONS

International Search Report and Written Opinion for PCT/EP2019/025261, dated Oct. 22, 2019; pp. 1-11.

*Primary Examiner* — Jorge L Leon, Jr.
(74) *Attorney, Agent, or Firm* — Pearne & Gordon LLP

(57) ABSTRACT

A rocker arm assembly can comprise a cam side rocker arm portion configured to selectively rotate about a pivot location. The cam side rocker arm portion can comprise a first socket above the pivot location, and a cam end configured to receive a lift profile from a cam lobe. A valve side rocker arm portion can be configured to rotate about the pivot location relative to the cam side rocker arm portion. The valve side rocker arm portion can comprise a second socket above the pivot location. A lost motion spring can span between the first socket and the second socket.

20 Claims, 18 Drawing Sheets

Related U.S. Application Data of application No. PCT/EP2019/025261, filed on Aug. 7, 2019.

(60) Provisional application No. 62/706,712, filed on Aug. 9, 2018.

(58) Field of Classification Search
USPC ..... 123/90.39, 90.44
See application file for complete search history.

(56) References Cited

U.S. PATENT DOCUMENTS

| | | | | |
|---|---|---|---|---|
| 6,615,782 | B1 | 9/2003 | Hendriksma et al. | |
| 6,769,387 | B2 | 8/2004 | Hayman et al. | |
| 7,210,435 | B2 * | 5/2007 | Decuir, Jr. | F01L 1/30 123/90.26 |
| 7,673,602 | B2 | 3/2010 | Masegi | |
| 7,827,944 | B2 | 11/2010 | Pierik | |
| 8,056,523 | B2 | 11/2011 | Ha et al. | |
| 8,365,691 | B2 | 2/2013 | Methley | |
| 8,550,047 | B2 | 10/2013 | Odell et al. | |
| 8,851,048 | B2 | 10/2014 | Meistrick | |
| 9,115,654 | B2 | 8/2015 | Schnell | |
| 11,136,906 | B2 | 10/2021 | Van Wingerden et al. | |
| 11,313,253 | B2 | 4/2022 | Van Wingerden et al. | |
| 11,319,840 | B2 | 5/2022 | Van Wingerden et al. | |
| 2001/0023672 | A1 | 9/2001 | Cecur | |
| 2002/0195072 | A1 | 12/2002 | Spath et al. | |
| 2005/0188930 | A1 | 9/2005 | Best | |
| 2006/0236968 | A1 | 10/2006 | Falkowski et al. | |
| 2008/0083385 | A1 | 4/2008 | Han et al. | |
| 2008/0271693 | A1 | 11/2008 | Edelmayer et al. | |
| 2014/0182539 | A1 | 7/2014 | Gron, Jr. et al. | |
| 2016/0160708 | A1 | 6/2016 | Choi et al. | |
| 2017/0009610 | A1 | 1/2017 | Ahmed et al. | |
| 2017/0145876 | A1 | 5/2017 | Pham | |
| 2017/0198610 | A1 | 7/2017 | Haefner | |
| 2017/0284313 | A1 | 10/2017 | Shewell | |
| 2020/0408113 | A1 | 12/2020 | Radulescu et al. | |
| 2021/0262366 | A1 | 8/2021 | Van Wingerden et al. | |
| 2021/0310379 | A1 | 10/2021 | Van Wingerden et al. | |

FOREIGN PATENT DOCUMENTS

| | | | | |
|---|---|---|---|---|
| CN | 107701253 | A | 2/2018 | |
| DE | 4025569 | C1 | 7/1991 | |
| DE | 102004005594 | A1 | 8/2005 | |
| DE | 102008059207 | A1 | 6/2010 | |
| EP | 0995885 | A2 | 4/2000 | |
| EP | 1712748 | A1 * | 10/2006 | F01L 1/18 |
| EP | 1712748 | B1 | 4/2010 | |
| EP | 3029283 | A1 | 6/2016 | |
| FR | 2990483 | A1 | 11/2013 | |
| GB | 2333322 | A | 7/1999 | |
| KR | 20140049409 | A | 4/2014 | |
| WO | 2017182631 | A1 | 10/2017 | |
| WO | WO-2020/030298 | A1 | 2/2020 | |

* cited by examiner

ROCKER ARM ASSEMBLY WITH LOST MOTION SPRING

PRIORITY

This application is a continuation in part of, and claims priority to, U.S. patent application Ser. No. 17/018,008 filed Sep. 11, 2020, which is a bypass continuation in part of and claims priority to Patent Cooperation Treaty application PCT/EP2019/025261 filed Aug. 7, 2019, which claims the benefit of priority of U.S. provisional patent application Ser. No. 62/716,712 filed Aug. 9, 2018. The priority documents are incorporated herein by reference in their entirety.

FIELD

The present disclosure relates generally to a rocker arm assembly for use in a valve train assembly and more particularly to a rocker arm assembly having a lost motion spring over the rocker shaft and a latch pin for a deactivating rocker arm assembly capable of full lift, partial lift, or no lift.

BACKGROUND

Many internal combustion engines utilize rocker arms to transfer rotational motion of cams to linear motion appropriate for opening and closing engine valves. Deactivating rocker arms incorporate mechanisms that allow for selective activation and deactivation of the rocker arm. In a deactivated state, the rocker arm may exhibit lost motion movement. In order to return to an activated state from a deactivated state, the mechanism may require that the rocker arm be in a particular position or within a range of positions that may not be readily achieved while undergoing certain unconstrained movement while in the deactivated state, such as during excessive lash adjuster pump-up.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

The methods and devices disclosed herein overcome the above disadvantages and improves the art by way of rocker arm assemblies with a balance of reaction forces that places a lost motion spring over the rocker shaft.

A rocker arm assembly can comprise a cam side rocker arm portion configured to selectively rotate about a pivot location. The cam side rocker arm portion can comprise a first socket above the pivot location, and a cam end configured to receive a lift profile from a cam lobe. A valve side rocker arm portion can be configured to rotate about the pivot location relative to the cam side rocker arm portion. The valve side rocker arm portion can comprise a second socket above the pivot location. A lost motion spring can span between the first socket and the second socket.

The first socket can form a ball-and-socket arrangement with a first end of the lost motion spring. The second socket can form a ball-and-socket arrangement with a second end of the lost motion spring.

A first positioning pin can be in the first socket, and a first end of the lost motion spring can be positioned on the first positioning pin. A second positioning pin can be in the second socket, and a second end of the lost motion spring can be positioned on the second positioning pin. The first positioning pin can comprise a rounded surface configured to interface with the first socket in a ball-and-socket arrangement. The first positioning pin can comprise a spring guide comprising one of a stake or a stepped surface. Or, the first socket can comprise a spring guide comprising one of a stake or a stepped surface.

The cam side rocker arm portion can comprise a first knurl protruding away from the pivot location. The first socket can be formed in the first knurl. The valve side rocker arm portion can comprise a second knurl protruding away from the pivot location. The second socket can be formed in the second knurl.

The pivot location can comprise a pivot axle joining the cam side rocker arm portion to the valve side rocker arm portion. The valve side rocker arm portion can comprise a rocker shaft bore. The pivot axle can be above the cam end. The cam side rocker arm portion can comprise a cam side latch body adjacent the cam end.

The pivot axle can be between the cam end and the first socket. The valve side rocker arm portion can comprise a rocker shaft bore. The pivot axle can be adjacent the rocker shaft bore. The valve side rocker arm portion can comprise a valve side latch body below the rocker shaft bore. The valve side rocker arm portion can comprise a valve side latch body adjacent the cam end.

The valve side rocker arm portion can comprise a rocker shaft bore. And, the cam side rocker arm portion can comprise a body portion configured to partially or completely encircle a rocker shaft adjacent the rocker shaft bore.

Alternatively, a rocker arm assembly can comprise a cam side rocker arm configured to rotate about a pivot location. The cam side rocker arm can comprise a cam end, a cam side latch body extending away from the cam end, and a first socket extending away from the cam end. A valve side rocker arm can be configured to rotate about the pivot location. The valve side rocker arm can comprise a second socket extending away from the pivot location, a valve side latch body extending away from the pivot location, and a valve end extending away from the pivot location. A lost motion spring can be biased between the first socket and the second socket. The lost motion spring can be configured with a first end in a ball-and-socket arrangement with the first socket, and the lost motion spring can be configured with a second end in a ball-and-socket arrangement with the second socket.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Reference will now be made in detail to the examples which are illustrated in the accompanying drawings. Directional references such as "left" and "right" are for ease of reference to the figures.

Figure 1A:
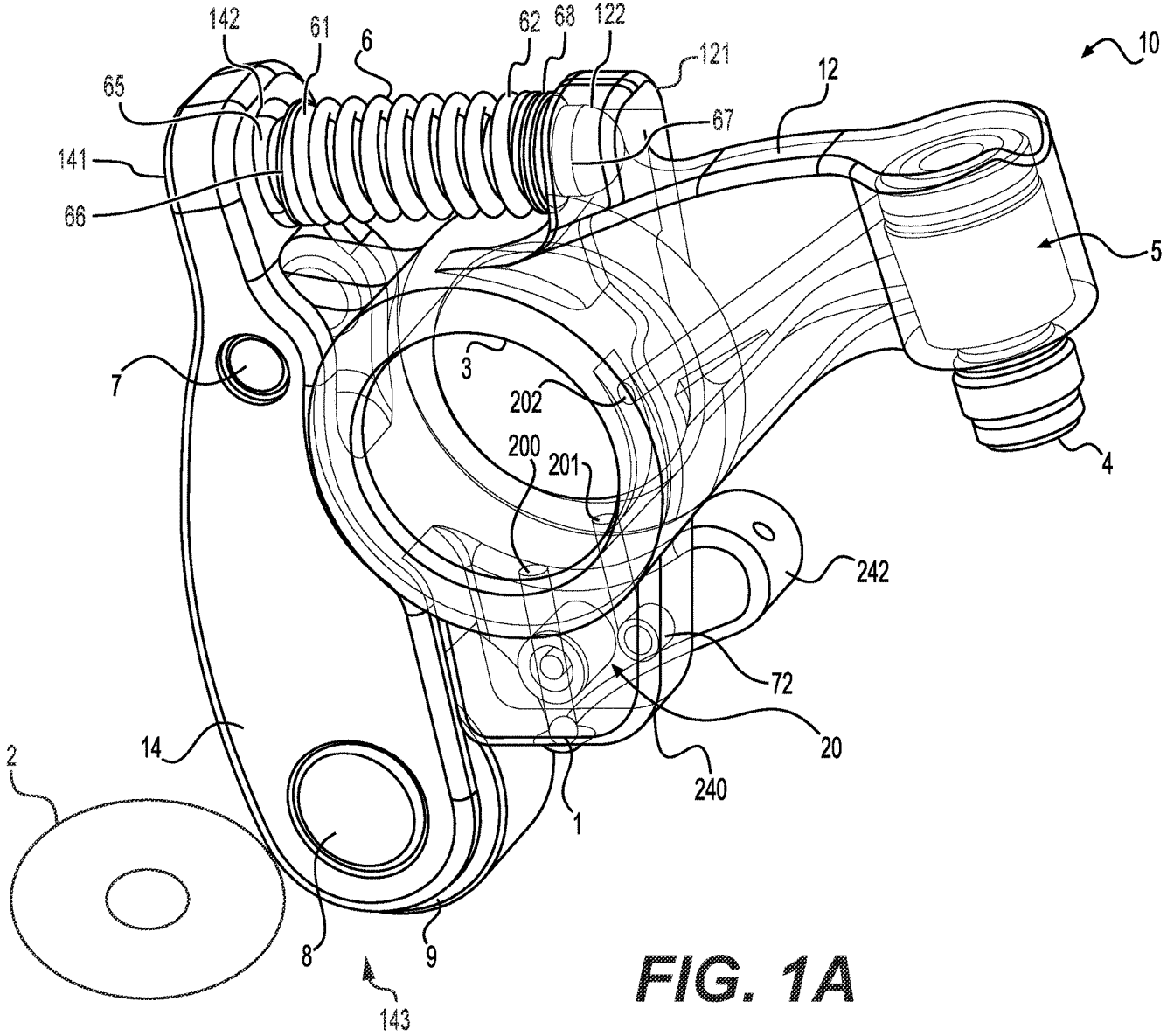
FIGS. 1A & 1B are views of alternative rocker arm assemblies having alternative pivot locations.
Figure 1B:
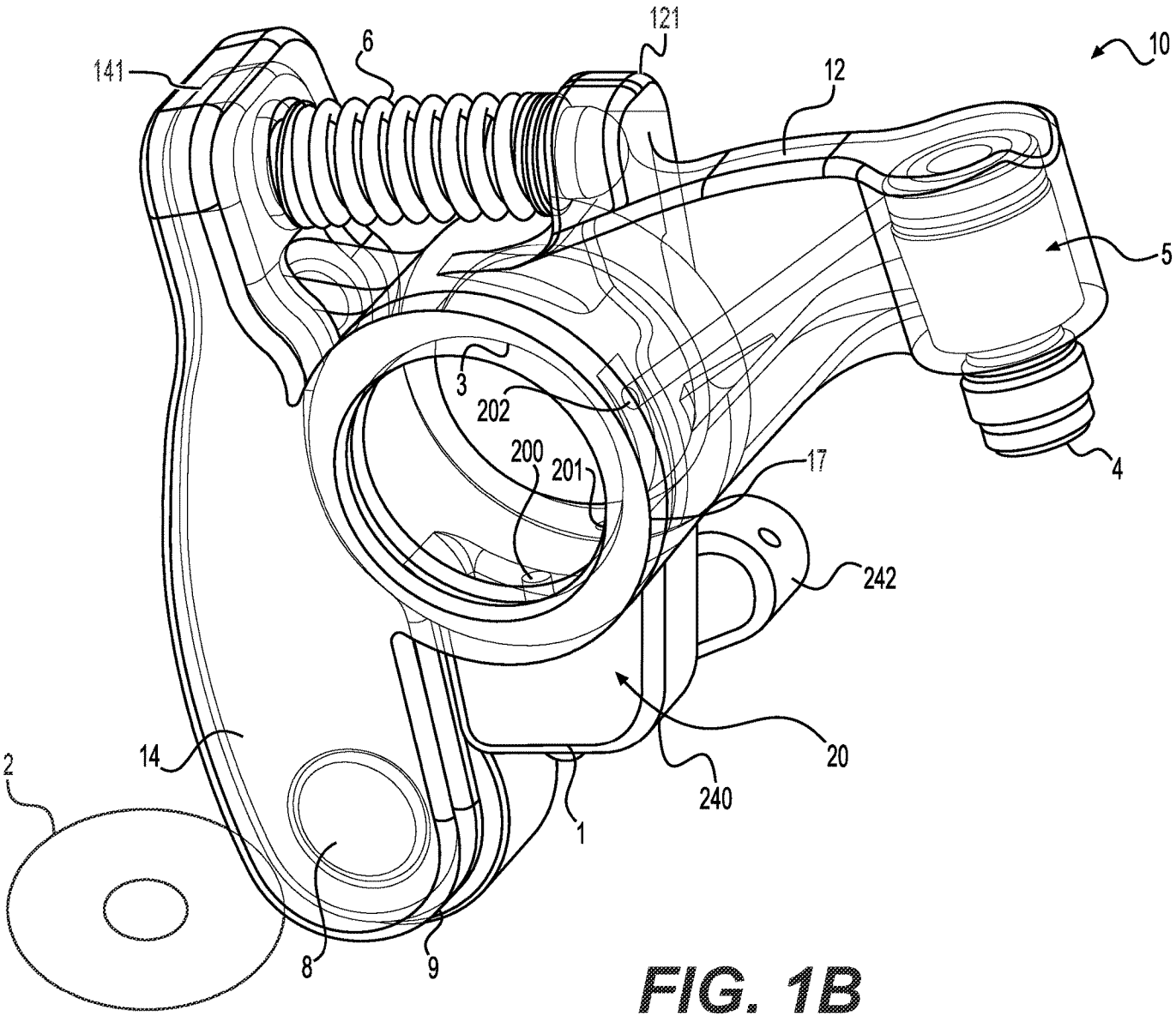

With reference to FIG. 1, a rocker arm assembly 10 is shown to include a valve side rocker arm portion 12 and a cam side rocker arm portion 14. A latch pin assembly 20 moves between various positions to achieve different operating conditions. The latch pin assembly 20 operates as a mechanical latch pin for a deactivating the rocker arm assembly 10. In this regard, the rocker arm assembly 10 is capable of full lift, partial lift, or no lift.

The rocker arm assembly 10 is shown as a type III, center pivot. It can comprise a roller bearing 9 on a bearing axis 8 for interfacing with a cam rail. A cam lobe 2 on the cam rail can impart a valve lift profile to the rocker arm assembly 10 by transferring actuation forces to the roller bearing 9 or alternative tappet at the cam end 143 of the cam side rocker arm portion 14. A tappet interface can substitute for the roller bearing 9 and bearing axis 8. The roller bearing 9 or tappet of the cam end 143 can be below the pivot location, among other locations.

The pivot location can be at a pivot axle 7 joining bores in the cam side rocker arm portion 14 and valve side rocker arm potion 12. Or, the pivot location can be formed by a body portion 17 of the cam side rocker arm portion 14. Body portion 17 can be configured to partially or completely encircle a rocker shaft adjacent rocker shaft bore 3 of valve side rocker arm portion 12.

The cam side rocker arm portion 14 and the valve side rocker arm portion 12 can pivot with respect to one another, rotating around a pivot axle 7. Or, the pivot location for the cam side rocker arm portion 14 and the valve side rocker arm portion 12 can be shared about the rocker shaft bore 3, as by extending the material of the body portion 17 of the cam side rocker arm portion 14 around the rocker shaft bore and eliminating the pivot axle 7. Then, rotation is around the rocker shaft for both halves of the rocker arm assembly 10.

A spring 6 can be biased between the cam side rocker arm portion 14 and the valve side rocker arm portion 12. The spring can enable lost motion valve lift profiles, including zero lift profiles, as described more below, when the latch pin assembly 20 is configured for lost motion. And, the spring 6 can bias the cam side rocker arm portion 14 and valve side rocker arm portion 12 for specialty lift profiles, such as early, extended, or late opening or closing lift profiles. A first end 61 of spring 6 can seat on a lip 66 of a first positioning pin 65. A second end 62 of spring 6 can seat on a second lip 68 of a second positioning pin 65. Cam side rocker arm portion 14 can comprise a knurl 141 with a first socket 142 to form a ball-and-socket arrangement with the first positioning pin 65. Valve side rocker arm portion 12 can comprise a second knurl 121 with a second socket 122 to form a ball-and-socket arrangement with the second positioning pin 67. Second knurl 121 can protrude away from the pivot location as by extending away from the portion of valve side rocker arm portion 12 that is around pivot axle 7. First and second positioning pins 65, 67 can comprise a rounded surface to interface with the first and second sockets 142, 122. A sliding, rocking, twisting, or other motion can occur in the first and second sockets 142, 122 as the spring 6 flexes during rocker arm assembly 10 use. The spring 6 can have a spring force to push the valve side rocker arm portion 12 away from the cam side rocker arm portion 14. But when the latch 20 is unlatched, the knurl 141 can press the spring 6 and collapse it towards the knurl 121. The spring force of spring 6 can be less than the force necessary to move the valve end 4 while of sufficient strength so that the roller 9 or tappet follows the cam 2.

In lieu of the first or second positioning pin 65, 67, the spring 6 can be formed so that the first and second ends 61, 62 can flex and move in the first and second sockets 142, 122 in a ball-and-socket arrangement. The first and second ends 61, 62 can be turned in a tapering shape, for example. In lieu of the first and second positioning pin 65, 67, the first and second sockets 142, 122 can comprise a stationary stake, pin, stepped surface, or other spring guide. Or, the first and second positioning pin 65, 67 can comprise a stake, pin, stepped surface or other spring guide in addition to or alternative to lips 66, 68. The spring guide can allow the spring 6 to flex yet restrict the spring 6 so that it does not stray off the rocker arm assembly 10. Spring guide can comprise a raised portion that forms the spring seat. This raised portion can interface with an inner diameter of the spring 6 to ensure that the spring 6 does not lose contact with the first and second sockets 142, 122 or first and second positioning pins 65, 67.

The valve side rocker arm portion 12 can comprise a variety of additional aspects such as a lash adjuster, deactivating capsule, engine brake capsule, among others as by an insert 5. An engine valve stem can connect directly or indirectly at an elephant foot (e-foot), spigot, cleat, or other guide at the valve end 4, and valve bridges and other valve connections can be used.

Figure 2:
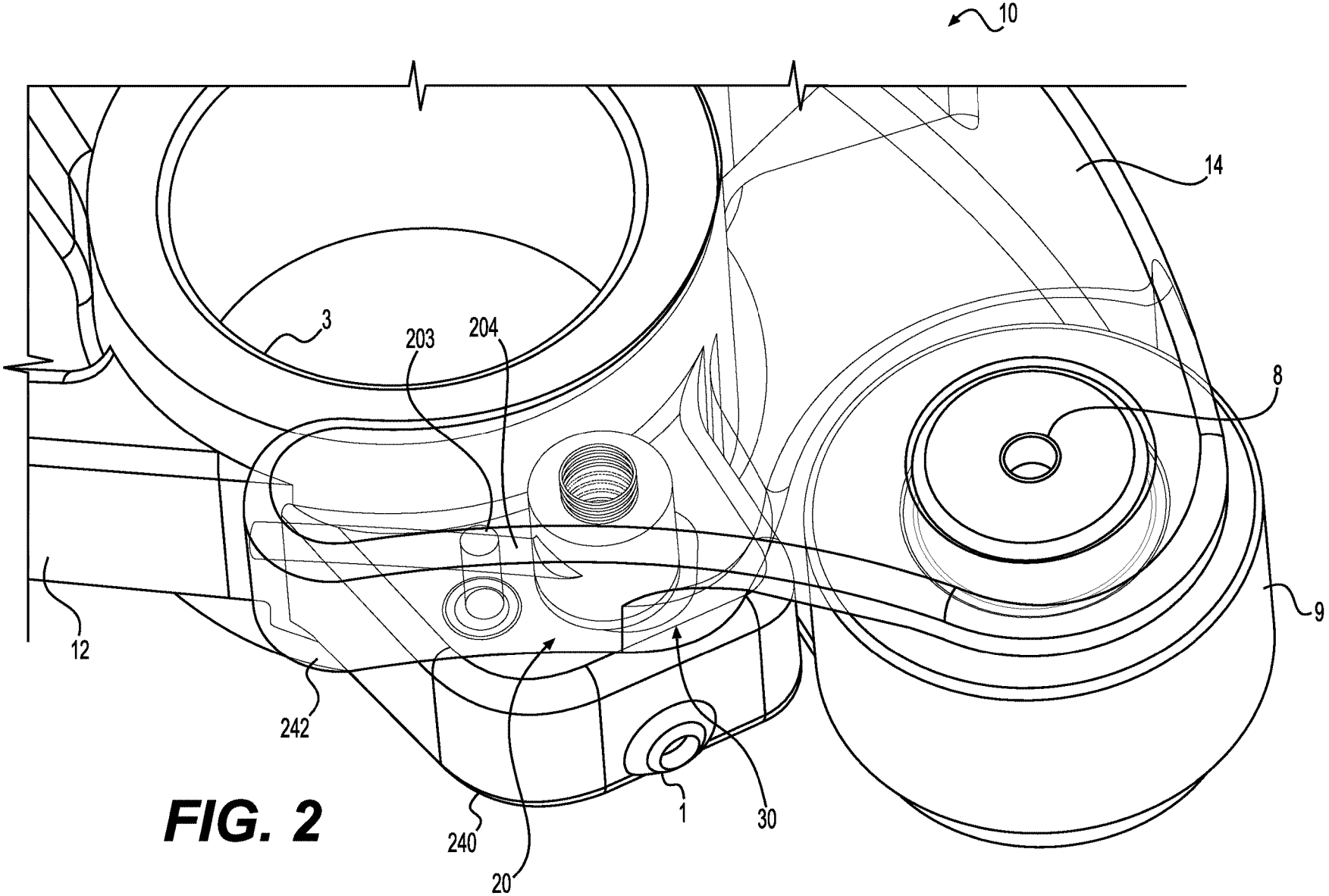
FIG. 2 is a perspective view of the latch pin assembly of the rocker arm assembly of FIG. 1A.

The rocker shaft bore 3 can couple to a rocker shaft and the rocker shaft can be configured to supply pressurized control fluid to the rocker arm assembly 10. Then, internal oil channels 200-204 can supply control fluid. For example, oil channel 202 can supply control fluid to enable hydraulic lash adjustment in the insert 5, or to enable engine braking or cylinder deactivation functionality, as per the insert 5. Oil channel 200 in valve side latch body 240 of valve side rocker arm portion 12 can supply control fluid to the latch pin assembly 20. Oil channel 201 in cam side latch body 242 can supply a separate control fluid. Oil channels 200-202 connect to receive fluid from the rocker shaft bore 3, and oil channels 203, 204 can be formed for additional functionality, such as an EEVO (early exhaust valve opening) control fluid. The oil channels 200-204 can be drilled or cast or otherwise formed into the rocker arm assembly 10, and in some alternatives plugs 1, 1170 can be used to fluidly seal an end of the oil channel, as shown for oil channel 200 in FIG. 1. Or, a controlled leak path or relief path 1171 can be formed through the plug, as in FIG. 2 or 14. Control of the pressurized fluid in the oil channels 200-204 permit control of the rocker arm assembly 10 functionality among the variable valve actuation strategies available (capsule-controlled options such as cylinder deactivation, lash adjustment, & engine braking and latch pin assembly-controlled options such as extended, early, late or nominal lift profiles, as alternatives to the below described full lift mode, partial lift mode, and a lost motion lift mode).

A slot 30 is defined in the cam side rocker arm portion 14. The latch pin assembly 20 engages the slot 30 in a way that is normally latched and allows for lost motion when disengaged, and that also engages in a way as referred to herein as partially engaged. Slot 30 comprises on one side, shown in valve side latch body 240 of valve side rocker arm portion 12, a primary oil control cavity 70. On the other side of slot 30, shown in body portion 242 of cam side rocker arm portion 14, a secondary oil control cavity 72 is formed. Latch pin assembly 20 is nested in slot 30 and comprises telescoping aspects to interface with channels 440, 540, 4400, 5400, 701, 722, 1701, 1722 and rims 401, 402, 4010, 4020 to provide at least two valve lift profiles to one or more valves coupled to the rocker arm, and to provide at least three valve lift profiles.

Figure 3:
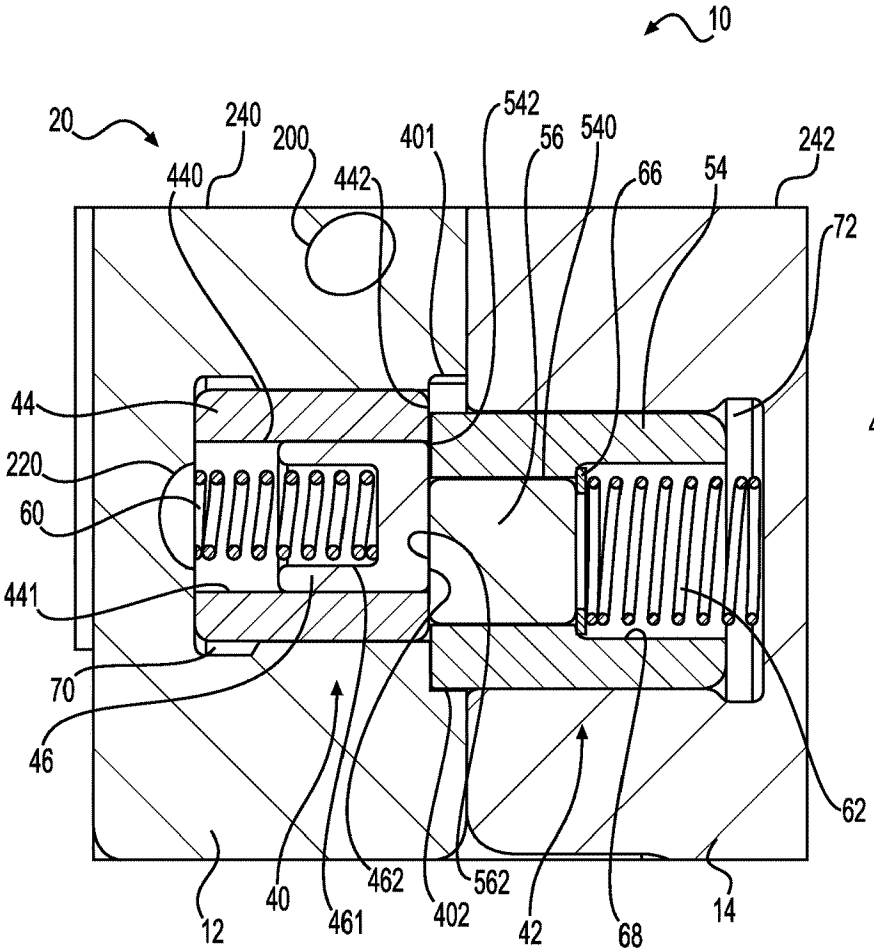
FIG. 3 is a sectional view of the latch pin assembly of FIG. 2 and shown in normal lift.

Referring now to FIG. 3, the latch pin assembly 20 generally includes a primary latch pin assembly 40 and a secondary latch pin assembly 42. The primary latch pin assembly 40 generally includes a first primary pin 44 and a second primary pin 46. The secondary latch pin assembly 42 generally includes a first secondary pin 54 and a second secondary pin 56. A first biasing member 60 urges the second primary pin 46 rightward as viewed from FIG. 3 toward the secondary latch pin assembly 42. A second biasing member 62 urges the first secondary pin 54 leftward as viewed in FIG. 4 toward the primary latch pin assembly 40. A lock ring 66 is positioned in a blind bore 68 that the second biasing member 62 biases against. The primary latch pin assembly 40 nests in a primary oil control cavity 70. The secondary latch pin assembly 42 nests in a secondary oil control cavity 72.

A first end 441 of first primary pin 44 can abut a back wall 1700 of oil control cavity 70 in FIG. 3. A first end 541 of second primary pin 54 can abut back wall 1720 of oil control cavity 72. A second end 442 of first primary pin 44 can abut a second end 542 of second primary pin 54. As shown by comparing the Figures, first primary pin 44 is arranged to telescope in and out of channel 701 of oil control cavity 70 in response to oil pressure from oil channel 200 to gland 220 and in response to opposing pressure from second primary pin 54. Second primary pin 54 can telescope in and out of channel 722 of secondary oil control cavity 72. The second biasing member can be designed with a force to bias second primary pin 54 out of the oil control cavity 72, and further oil control can cause second primary pin 56 to telescope out of secondary channel 540 of second primary pin 54 and towards (FIG. 3) or into (FIG. 4) primary channel 440 in first primary pin 44.

Outward surface 462 of first secondary pin 46 can be biased towards secondary latch pin assembly 42 by first biasing member 60 in a cavity 461. Outward surface 562 of second secondary pin 56 can be biased towards primary latch pin assembly 40 by the second biasing member 62 and by oil pressure to gland communicating with secondary oil control cavity 72. The blind bore 68 can be oil fed by oil channel 201. Lock ring 66 can seat second secondary pin 56. And, secondary pin 56 can be opposed and positioned in secondary channel 540 by oil pressure to second primary pin 46.

Figure 4:
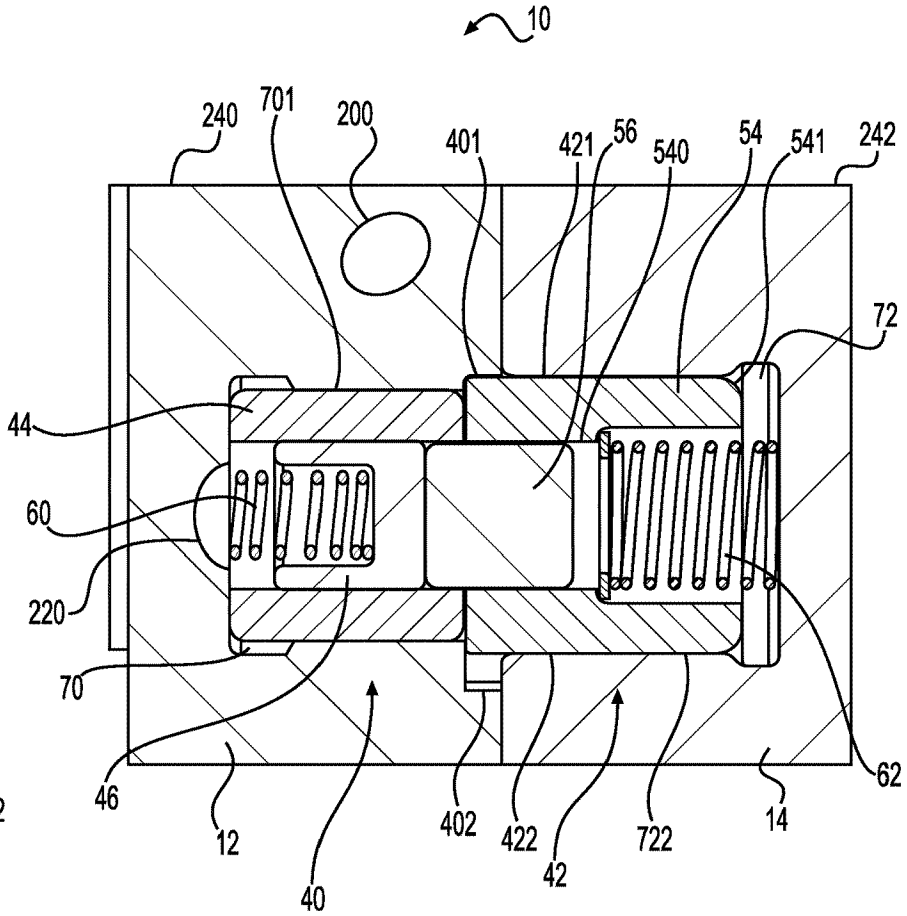
FIG. 4 is a sectional view of the latch pin assembly of FIG. 3 and shown in early exhaust valve opening (EEVO) lift.

With reference to FIGS. 3 and 4, with a primary oil pressure supplied to primary and secondary oil cavities 70, 72, a normal lift mode can be conveyed to a valve affiliated with the rocker arm assembly 10. In normal lift mode, the secondary latch pin assembly 42 can shuttle in rim of channel 701 between a first side 401 and second side 402 of the rim. A cam rolling against roller bearing 9 conveys a valve lift profile to the rocker arm, and the rim profile conveys another attribute of the valve lift profile. In FIG. 4, when pressurized oil is delivered to the secondary oil control cavity 72, then the second secondary pin 56 moves into engagement with the first primary pin 44 by telescoping out of channel 540 and into channel 440 for EEVO lift mode. The secondary latch pin assembly 42, being locked by its telescopic relationship with the second secondary pin, and being travel-limited by the first primary pin 44, cannot shuttle from side to side 401,402 of the rim and is locked adjacent rim 401 in FIG. 4. Thus, at least two valve lift modes are conveyed by controlling the latch pin assembly 20. To add a third valve lift mode, pressurized oil is delivered to the primary oil control cavity 70 and the second secondary pin 56 is caused to retreat rightward. The valve side rocker arm portion 12 and cam side rocker arm portion 14 are permitted to pivot relative to each other in a deactivated lift mode of FIG. 5. The deactivated lift mode can also be called a "lost motion" lift mode or "zero lift" mode because the lift profile from the cam lobe 2 to roller bearing 9 of cam side rocker arm portion 14 is not transferred to the valve side rocker arm portion 12. It is "lost" when the latch pin assembly 20 does not transfer cam lobe motion from the cam side rocker arm portion 14 to the valve side rocker arm portion 12. When the valve side rocker arm portion 12 rotates relative to the cam side rocker arm portion 14, the cam side body portion 242 blocks the primary latch pin assembly 40 from telescoping out of its channel 701 while the valve side latch body 240 blocks the secondary latch pin assembly 42 from telescoping out of its channel 722.

Figure 5:
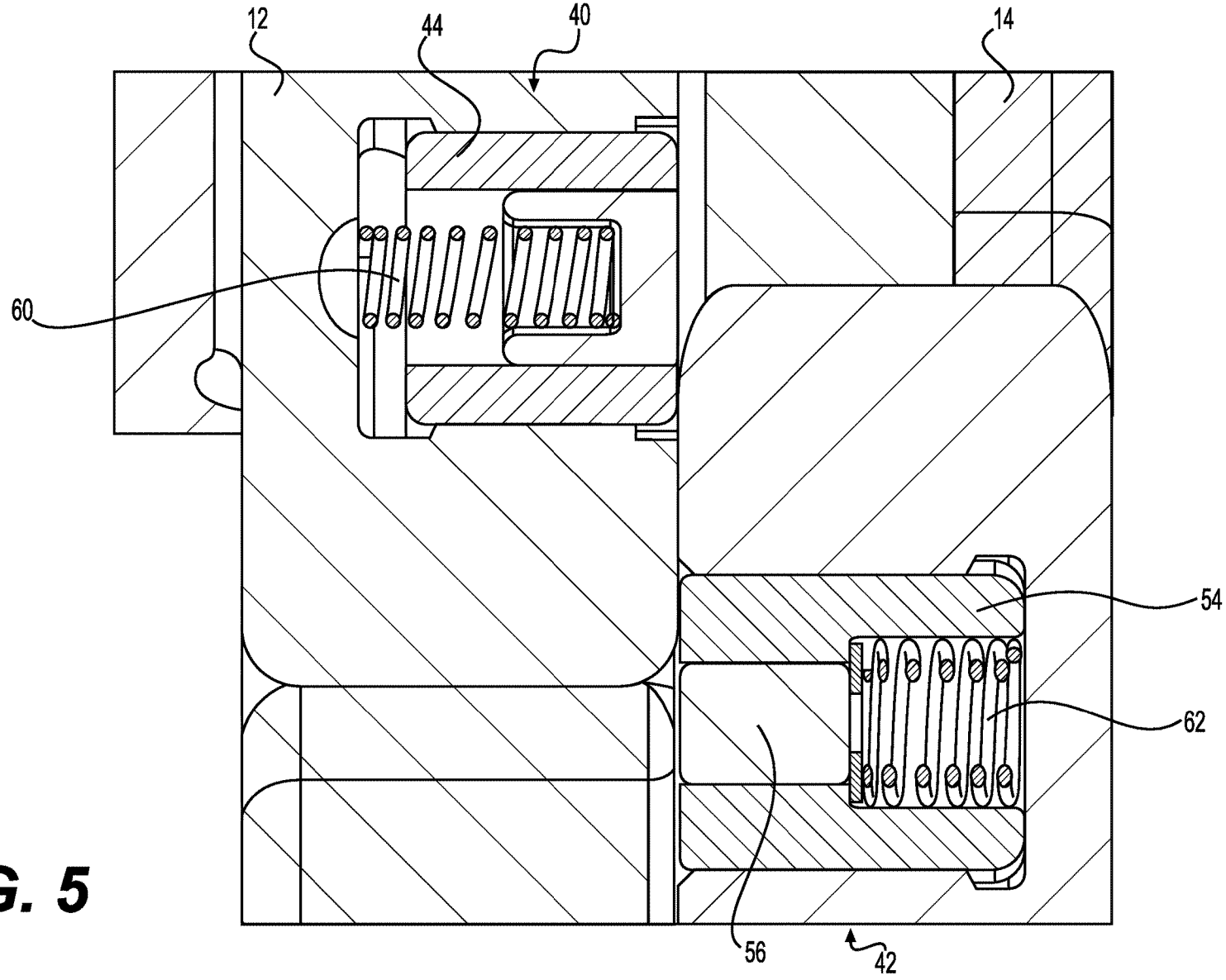
FIG. 5 is a sectional view of the latch pin assembly of FIG. 3 and shown in deactivated lift.
Figure 11:
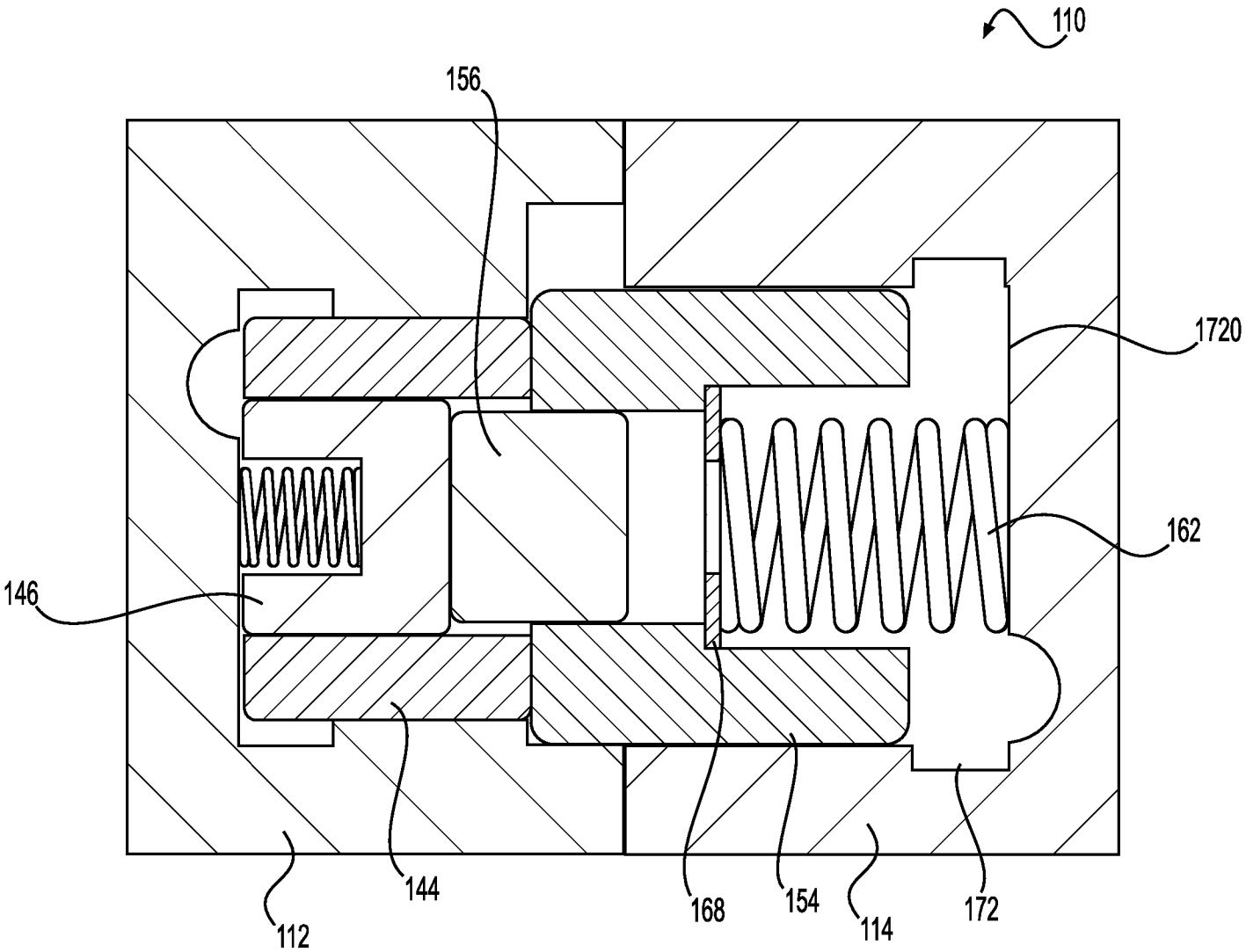
FIG. 11 is a sectional view of the latch pin assembly of FIG. 7 and shown in secondary control active with the latch fully engaged.

Comparing FIGS. 3-5, it can be seen that the rim of channel 701 does not have to be concentric, nor even circular. Side 401 can be closer or farther from a center point of channel 701 than side 402. Side 402 can be distanced more or less away from the center of channel 701 than side 401. Alternatively, the rim can be positioned on the cam side body portion 242 instead of on the valve side latch body 240. Comparing FIGS. 11 & 12, the valve side rocker arm portion 112 is moved relative to the cam side rocker arm portion 114 and this also reveals a benefit of the sides 4010, 4020 of the rim. The rim shape can be controlled to dictate a valve lift profile. When first secondary pins 54, 154 are configured to ride in the rim area during cam side rocker arm portion motion, the shape of the rim can modify the valve lift profile conveyed by the cam lobe 2.

With reference now to FIG. 7-12, a rocker arm assembly constructed in accordance to another example of the present disclosure is shown and generally identified at reference 110. The rocker arm assembly 110 can be constructed similarly to the rocker arm 10 described above wherein similar reference numerals are used to denote similar components. The rocker arm assembly 110 generally includes a valve side rocker arm portion 112 and a cam side rocker arm portion 114. A latch pin assembly 120 moves between various positions to achieve different operating conditions. The latch pin assembly 120 operates as a mechanical latch pin for deactivating the rocker arm assembly 110. In this regard, the rocker arm assembly 110 is capable of full lift, partial lift, or no lift. The rocker arm assembly 10 can be operated with the full lift or the partial lift as the nominal lift. That is, the full lift can constitute an extended or specialty lift while the partial lift is considered a nominal lift. Or, the full lift can be considered the nominal lift while the partial lift constitutes a specialty lift profile.

Outward surface 1462 of first secondary pin 146 can be biased towards secondary latch pin assembly 142 by first biasing member 160. Outward surface 1562 of second secondary pin 156 can be biased towards primary latch pin assembly 140 by the second biasing member 162 and by oil pressure to gland communicating with secondary oil control cavity 172. The blind bore 168 can be oil fed by oil channel 201. Lock ring 166 can seat second secondary pin 156. And, secondary pin 156 can be opposed and positioned in secondary channel 1540 by oil pressure to second primary pin 146.

Figure 8:
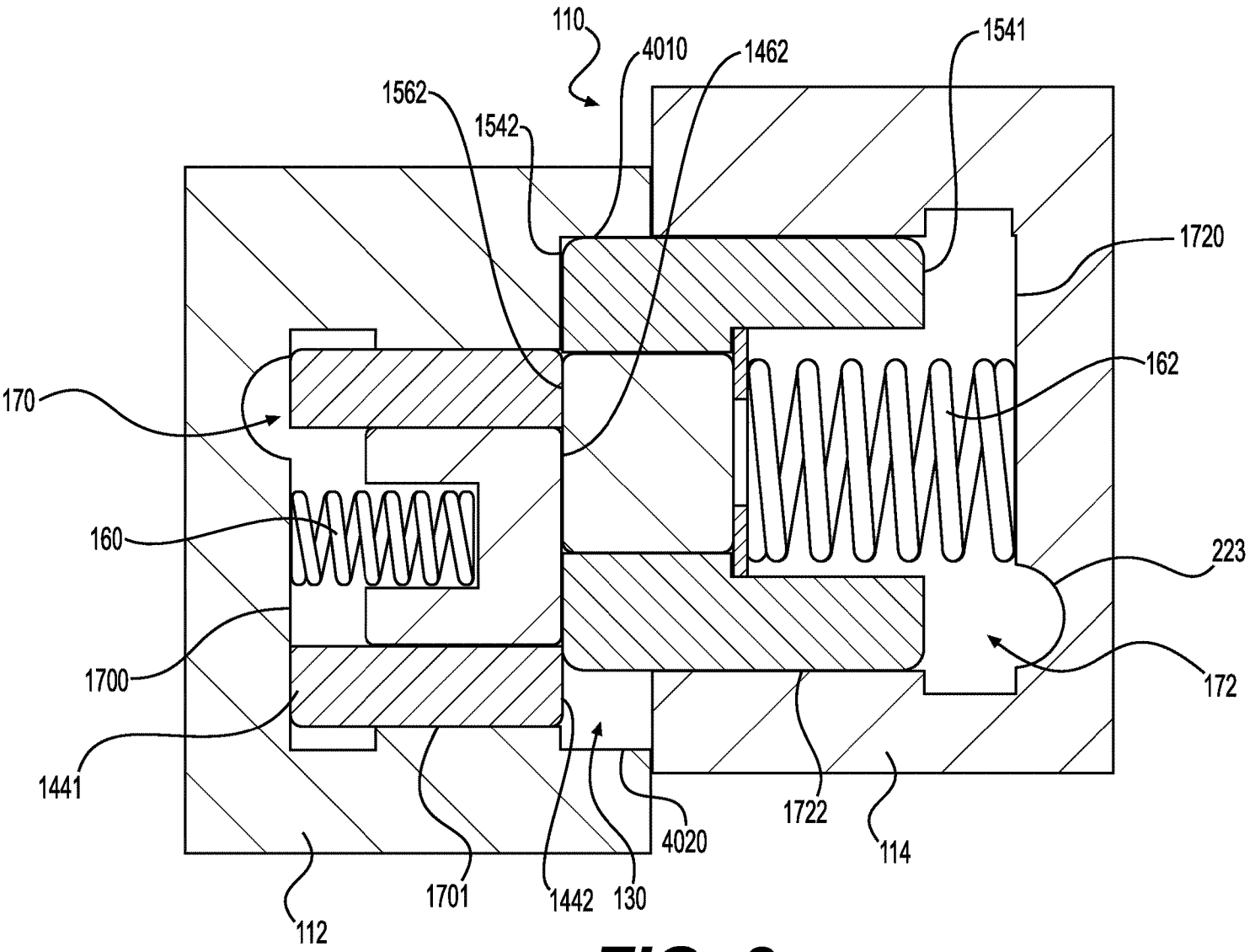
FIG. 8 is a sectional view of the latch pin assembly of FIG. 7 and shown in a normal lift position with the latch partially engaged.
Figure 9:
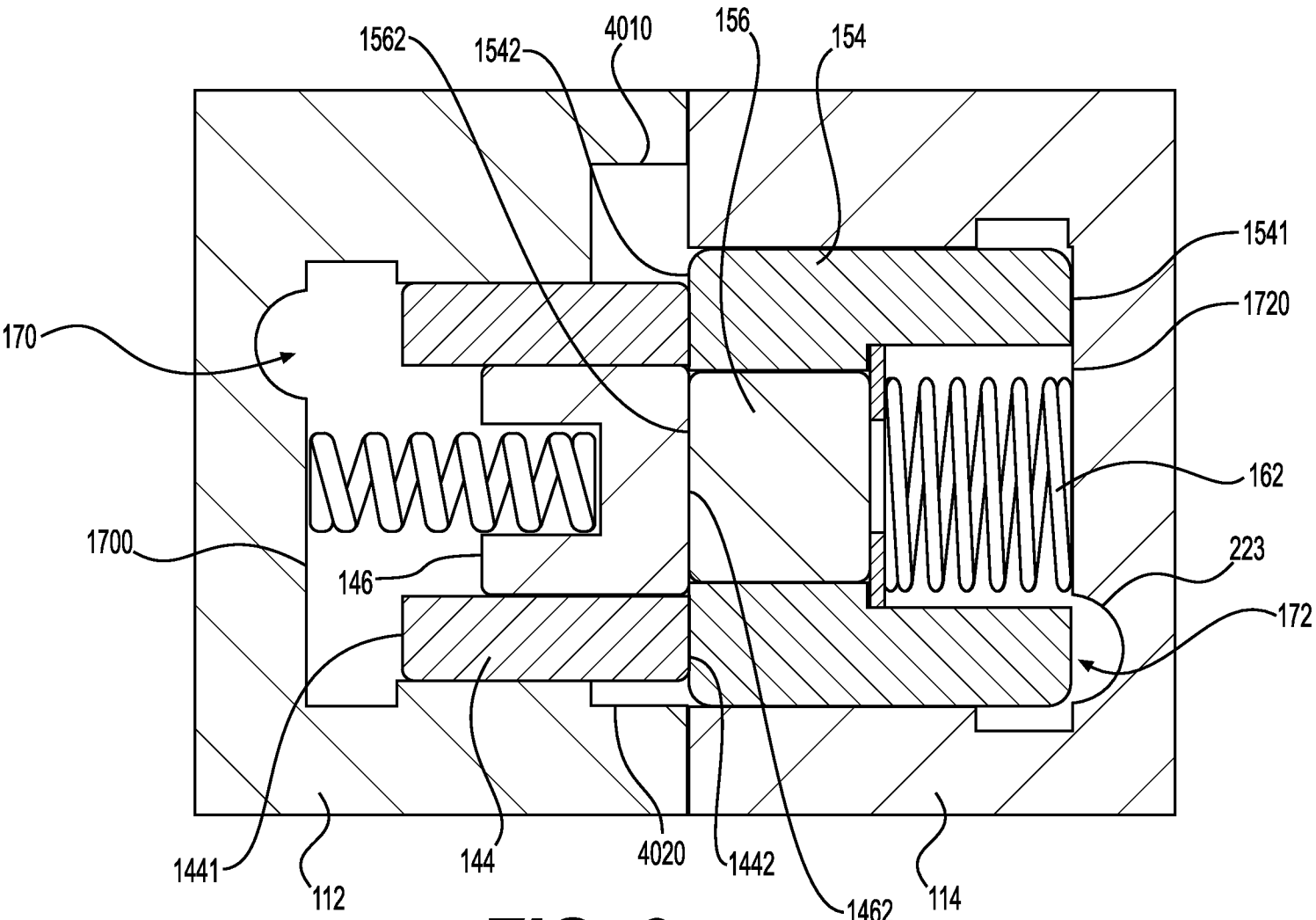
FIG. 9 is a sectional view of the latch pin assembly of FIG. 7 and shown in primary control active with the latch disengaged.

A first end 1441 of first primary pin 144 can abut a back wall 1700 of oil control cavity 170 in FIG. 8. A first end 1541 of second primary pin 154 can be distanced from back wall 1720 of oil control cavity 172 so that second end 1442 of first primary pin 144 can abut a second end 1542 of second primary pin 154. First primary pin 144 can serve as a travel limit for restricting protrusion of secondary latch pin assembly 142 into first latch pin assembly 140.

Figure 6:
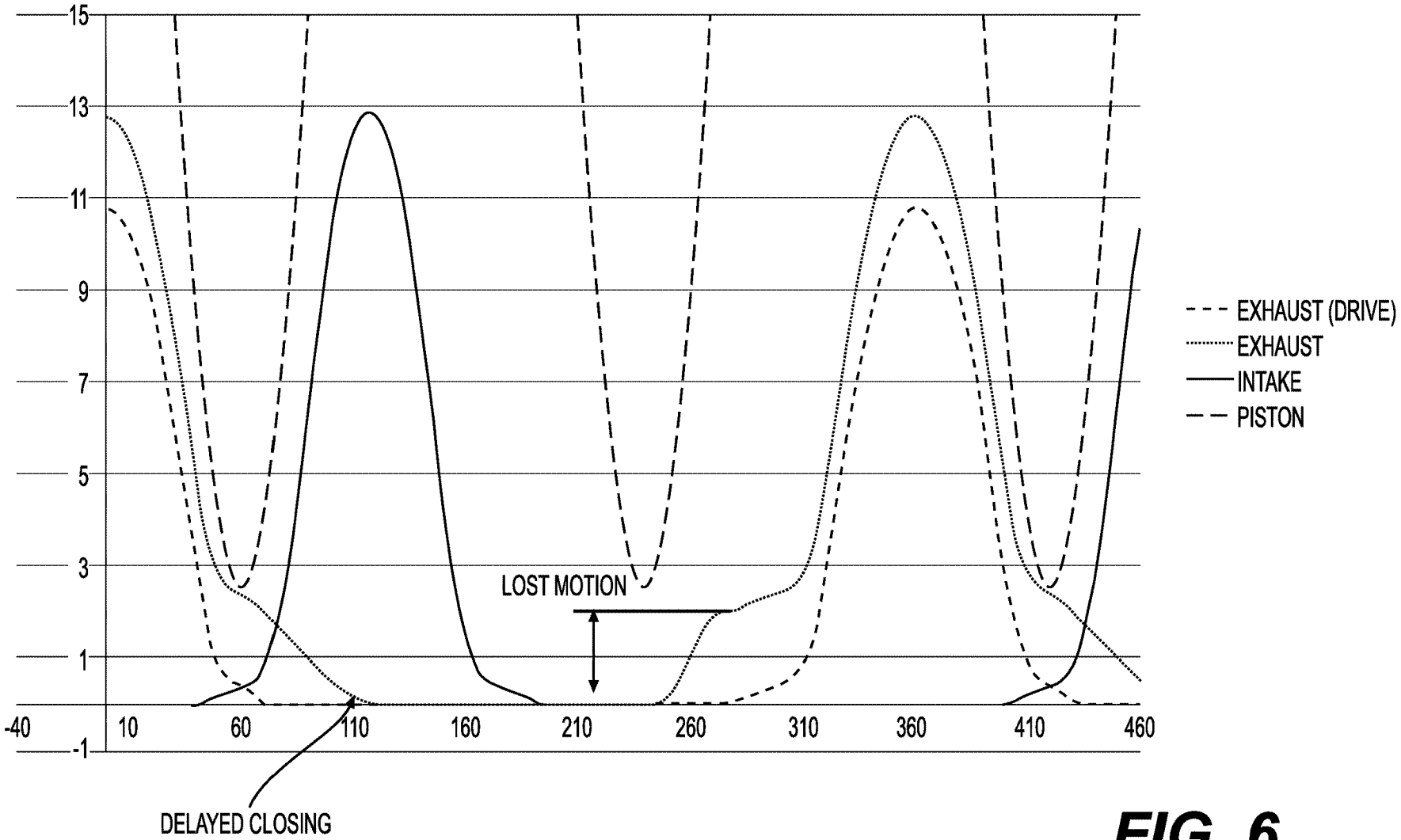
FIG. 6 is a plot illustrating EEVO, DRIVE, & lost motion lift profiles according to one example of the present disclosure.
Figure 7:
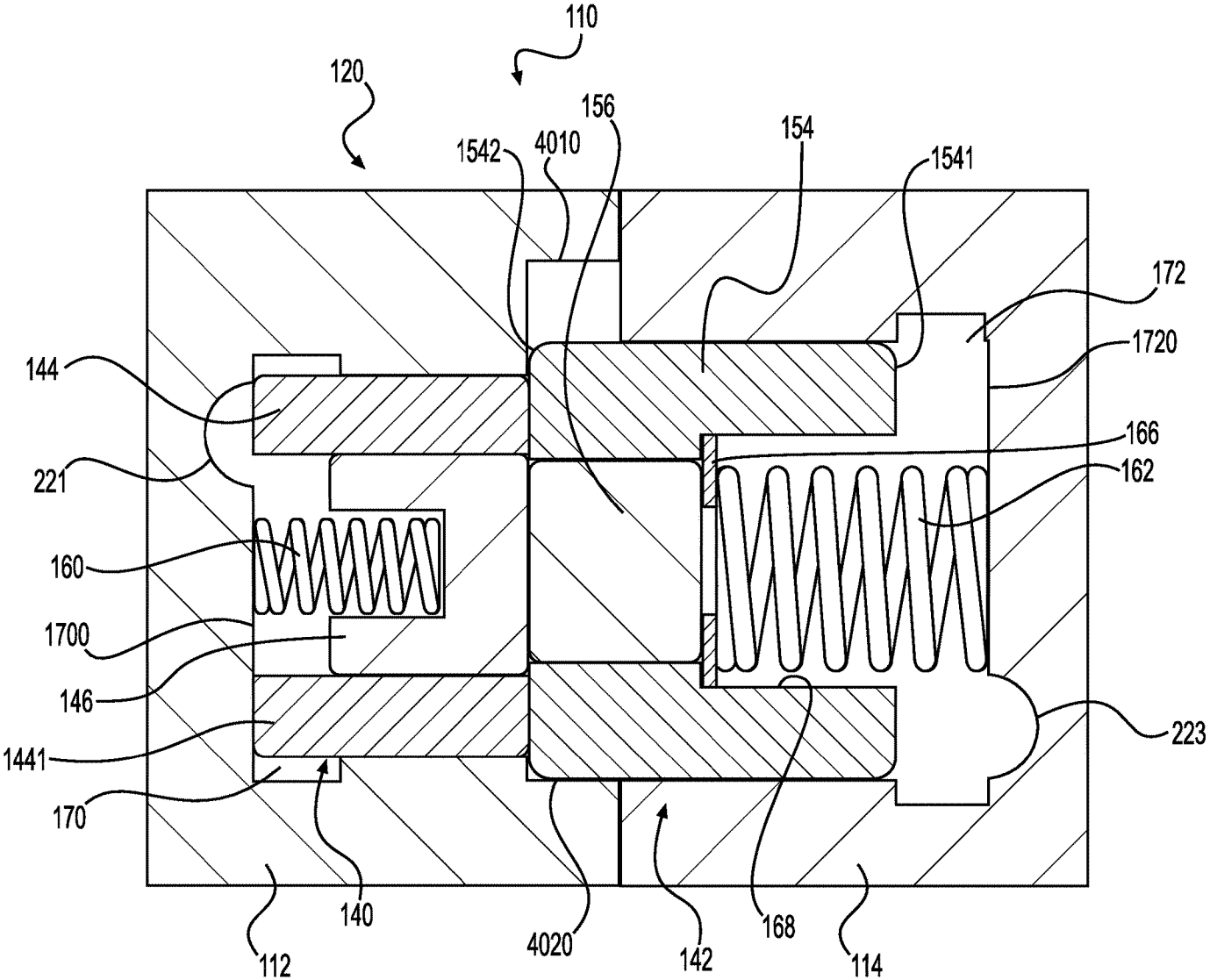
FIG. 7 is a sectional view of a latch pin assembly constructed in accordance to additional features of the present disclosure.

Turning to FIG. 6, the benefits of the rims and latch pin assemblies can be described. A cam profile on a cam lobe 2 can impart a valve lift profile to the rocker arm assemblies 10, 110. Shapes for the cam lobe 2 and set-ups to create a type III center pivot valvetrain can be used to press upon the roller bearing 9, which could alternatively be a tappet. The cam lobe 2 can be designed to impart a designated motion to the cam side rocker arm portion 14, 114. The designated motion can then be modified by controlling the latch assemblies disclosed herein and further modified by the design of the rims. Numerous variable valve actuation (VVA) lift modes become enabled, such as engine braking (EB), cylinder deactivation (CDA), early exhaust valve opening (EEVO), late intake valve closing (LIVC), internal exhaust gas recirculation (iEGR), intake recharge (iRC), among many others.

Figure 12:
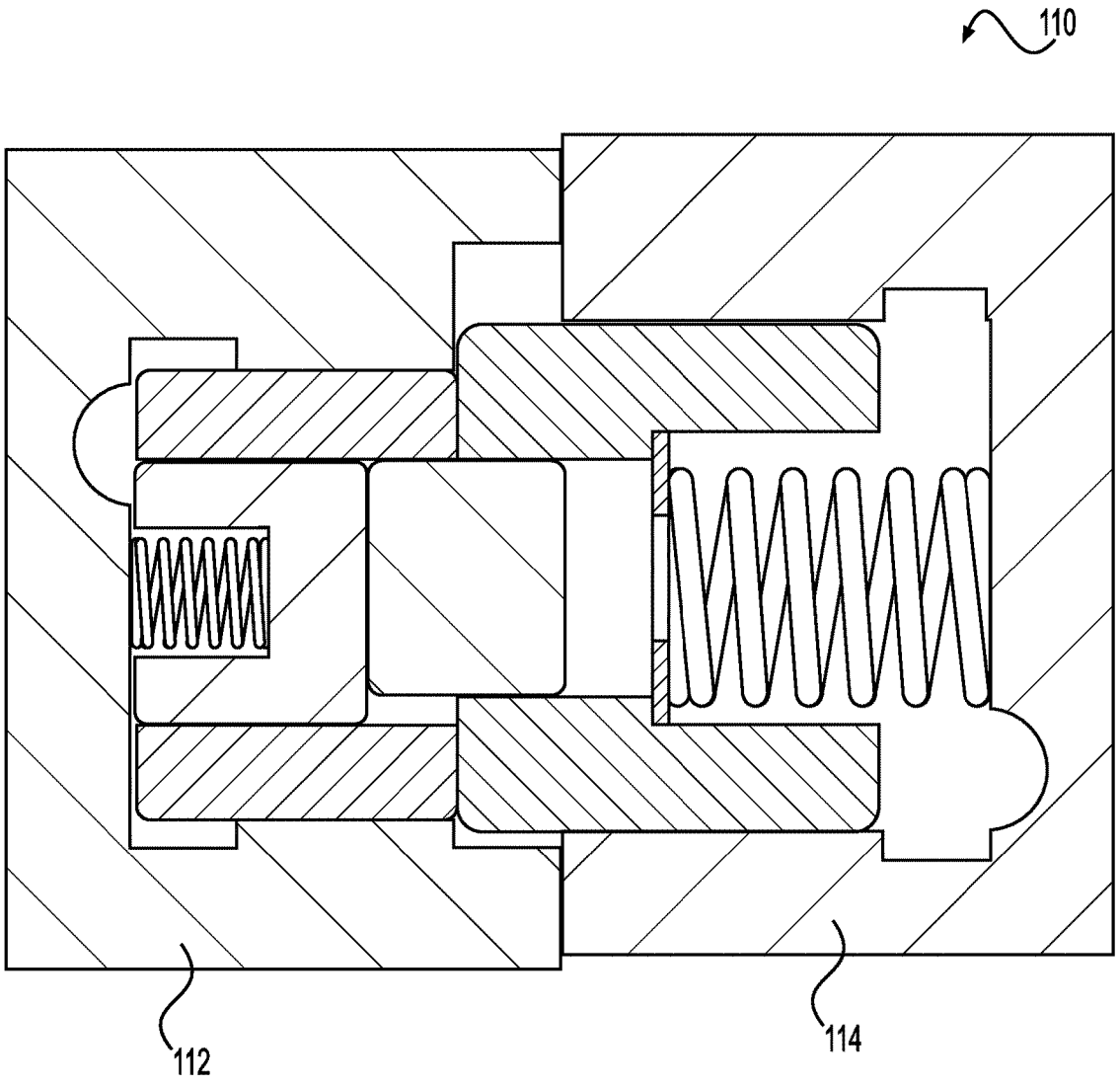
FIG. 12 is a sectional view of the latch pin assembly of FIG. 7 and shown in secondary control active with the latch fully engaged and with the valve side rocker arm portion moved relative to the cam side rocker arm portion.

In reference to FIGS. 4, 6, & 12, a full lift mode, meaning the largest or highest lift imparted by the cam lobe 2 acting on the cam side rocker arm portion 14, 114, is transferred from the cam lobe 2 to the cam side rocker arm portion 14 or 114, through the latch pin assembly and to the valve side rocker arm portion 12, 112. A valve affiliated with the rocker arm assembly 10, 110 would exhibit the EEVO dashed line profile of FIG. 6. At least a portion of the second secondary pin 56, 156 telescopes into at least a portion of the inner channel 440, 1440 of the first primary pin 44, 144. This pushes the second primary pin 46, 146 towards the base 1700 of the primary oil cavity 70. The position of the valve side rocker arm portion 12, 112 is locked with respect to the cam side rocker arm portion 14, 114 and the cam side rocker arm portion 14, 114 transfers all motion from the cam lobe 2. In this example, an EEVO lift profile is transferred that is higher and wider than the DRIVE lift mode shown in FIG. 6.

In reference to FIGS. 3 & 8, another valve lift mode can be a partial lift profile indicated by the dashed DRIVE line in FIG. 6. It can correspond to a "normal" or "nominal" lift mode, although it could also correspond to a low lift mode or other VVA technique and the first lift mode imparted can be designated "normal" or "nominal." In the example, it is desired to "lose" the motion that extends opening of the exhaust valve. So, the rim size and shape is chosen to yield the "lost motion" indicated in FIG. 6. The delayed closing of the exhaust valve, the extra height of the valve lift, and the early opening of the exhaust valve are all aspects that can be "lost" by controlling the latch pin assembly parameters and slot 30 parameters. The secondary latch pin assembly 42, 142 can shift in the rim between sides 401 & 402, 4010 & 4020 so that when the cam lobe 2 presses on the cam side rocker arm portion, that portion of the motion becomes "lost motion." So, the rim can be chosen to subtract from the cam lobe motion when the first secondary pin 54, 154 and second secondary pin 56, 156 ride in the rim. By controlling the spring force of second biasing member 62, 162 and the first biasing member 60, 160, the latch pin assembly can be designed so that the first primary pin 44, 144 and second primary pin 46, 146 are pressed back to reveal the rim absent sufficient oil pressure to gland 220, 221 to overcome spring force of the second biasing member 62,162.

Figure 10:
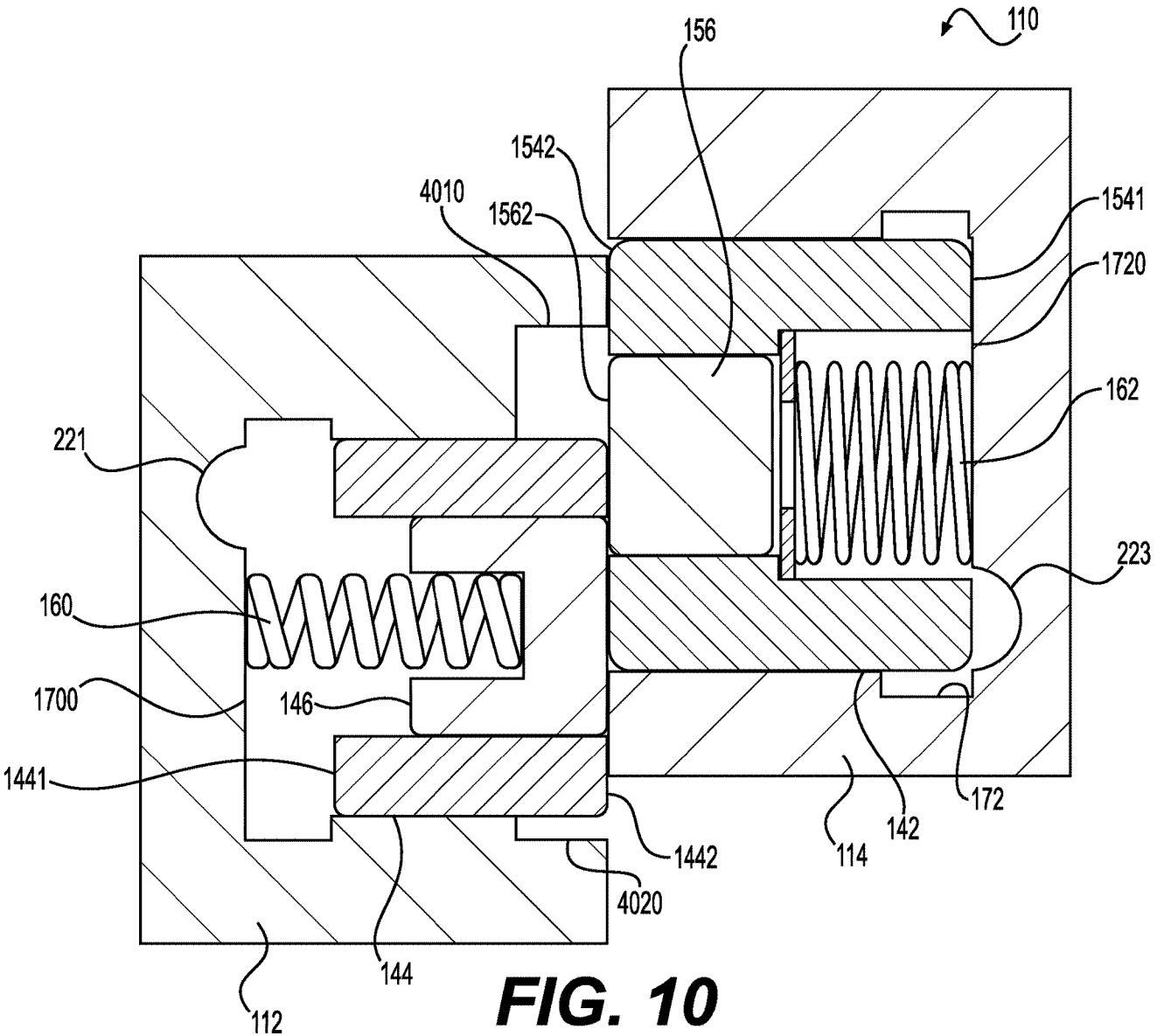
FIG. 10 is a sectional view of the latch pin assembly of FIG. 7 and shown in primary control active with the latch disengaged and with the valve side rocker arm portion moved relative to the cam side rocker arm portion.

Another kind of "lost motion" is shown in FIGS. 5 & 10. In this kind of lost motion, suitable for cylinder deactivation (CDA) lift modes, no cam lobe motion is transferred to the valve side rocker arm portion 12, 112. Oil pressure to oil cavity 70, 170 pushes second primary pin 46, 146 towards secondary latch pin assembly 42. The second primary pin 46, 146 can seat against lock ring 68, 166. When exiting the full lift mode, this can comprise pushing the second secondary pin 56, 156 out of the first primary pin 44, 144 and back into the first secondary pin 54, 154. Oil control to second oil cavity 72, 172 can comprise a low pressure or no pressure condition while oil control for primary oil cavity 70, 170 can comprise a higher oil pressure. First primary pin 44, 144 can also move due to oil pressure to oppose first secondary pin 54, 154 and due to relaxed forces from the secondary latch pin assembly 42, 142. With the secondary latch pin assembly 42, 142 pressed back and nested in secondary oil cavity 72, 172, the cam side rocker arm portion 14, 142 can move without transferring any motion to the valve side rocker arm portion 14, 142. Then, valve motion is deactivated for the affiliated valves.

FIGS. 13-17 show additional aspects of the latch pin assemblies 21, 22, 23, including contact-stress reducing and self-retracting features. The latch pin assembly can find application in other types of rocker arms, though it is shown in a type III rocker arm. So, in addition to latch and lash management aspects discussed above for latch pin assembly 20, the latch pin assemblies 21, 22, 23 can be combined with additional features to provide lower stress, critical shift mitigation, and latch retraction aspects. So, in addition to latch and lash management aspects, the latch pin assembly provides lower stress, critical shift mitigation, and latch retention aspects. The design yields manufacturing benefits including cost-effective designs for manufacturing the latch bores. The rocker arm assemblies 10, 110, 1110 can be configured to switch among a full lift mode, a partial lift mode, and a lost motion lift mode while yielding manufacturing benefits including cost-effective designs for manufacturing the latch bores.

With reference to FIG. 13-16, a rocker arm assembly constructed in accordance with another example of the present disclosure is shown and generally identified at reference 1110. The rocker arm assembly 1110 can be constructed similarly to the rocker arm 10 described above wherein similar reference numerals are used to denote similar components. Variant latch pin assemblies 21, 22, 23 can be positioned similarly to latch pin assemblies 20, 120 to control the relative motion of a cam side arm 1114 relative to a valve side arm 1112. The rocker arm assembly 1110 generally includes a valve side rocker arm portion 1112 and a cam side rocker arm portion 1114. A latch pin assembly 21, 22, 23 moves between various positions to achieve different operating conditions. The latch pin assembly 21, 22, 23 operates as a mechanical latch pin for selectively latching and deactivating the rocker arm assembly 1110. In this regard, the rocker arm assembly 1110 is capable of full lift or no lift. Aspects discussed herein for reducing contact stresses can be applied to the full lift, partial lift, and no lift examples above.

Figure 13:
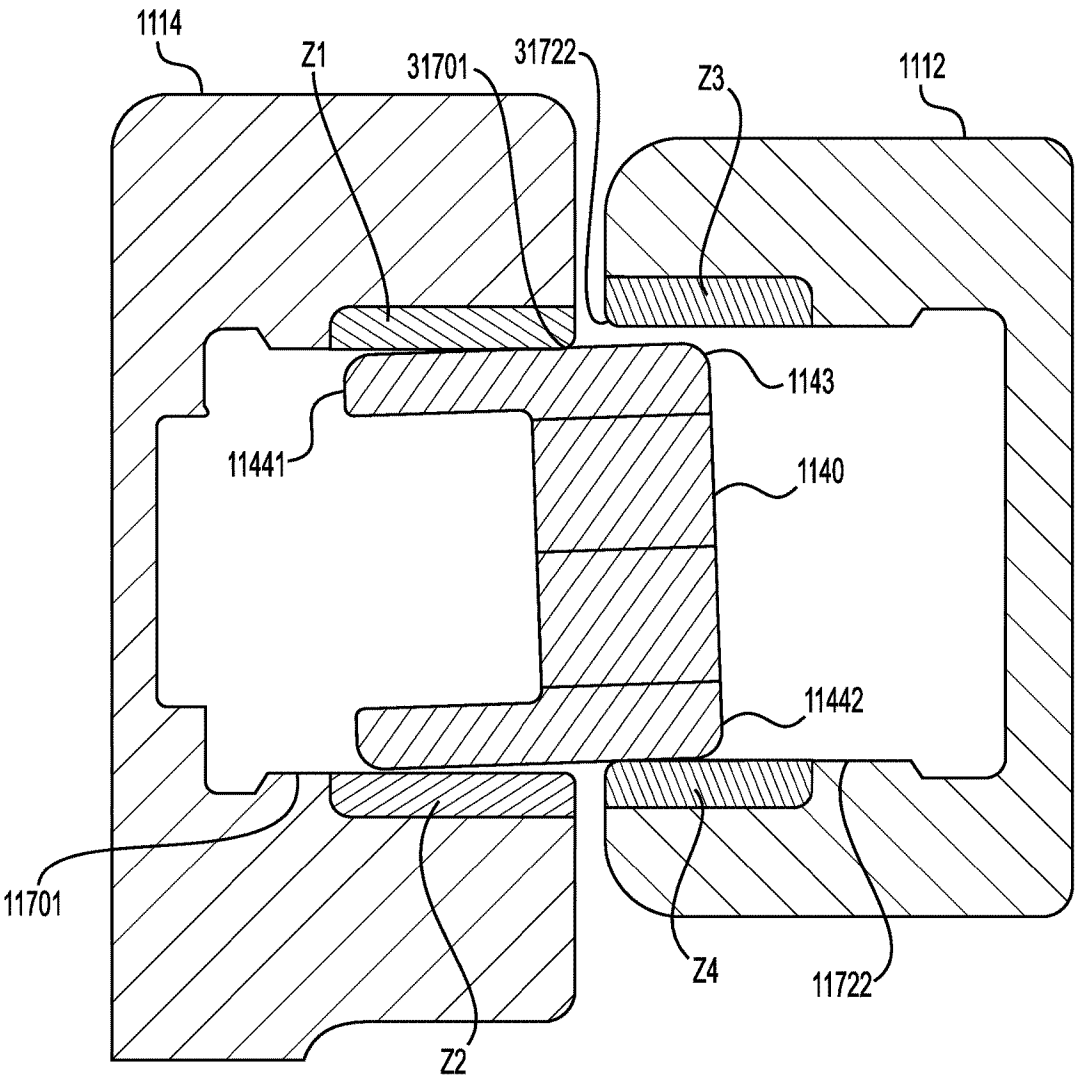
FIG. 13 is an illustration of a design consideration.
Figure 14:
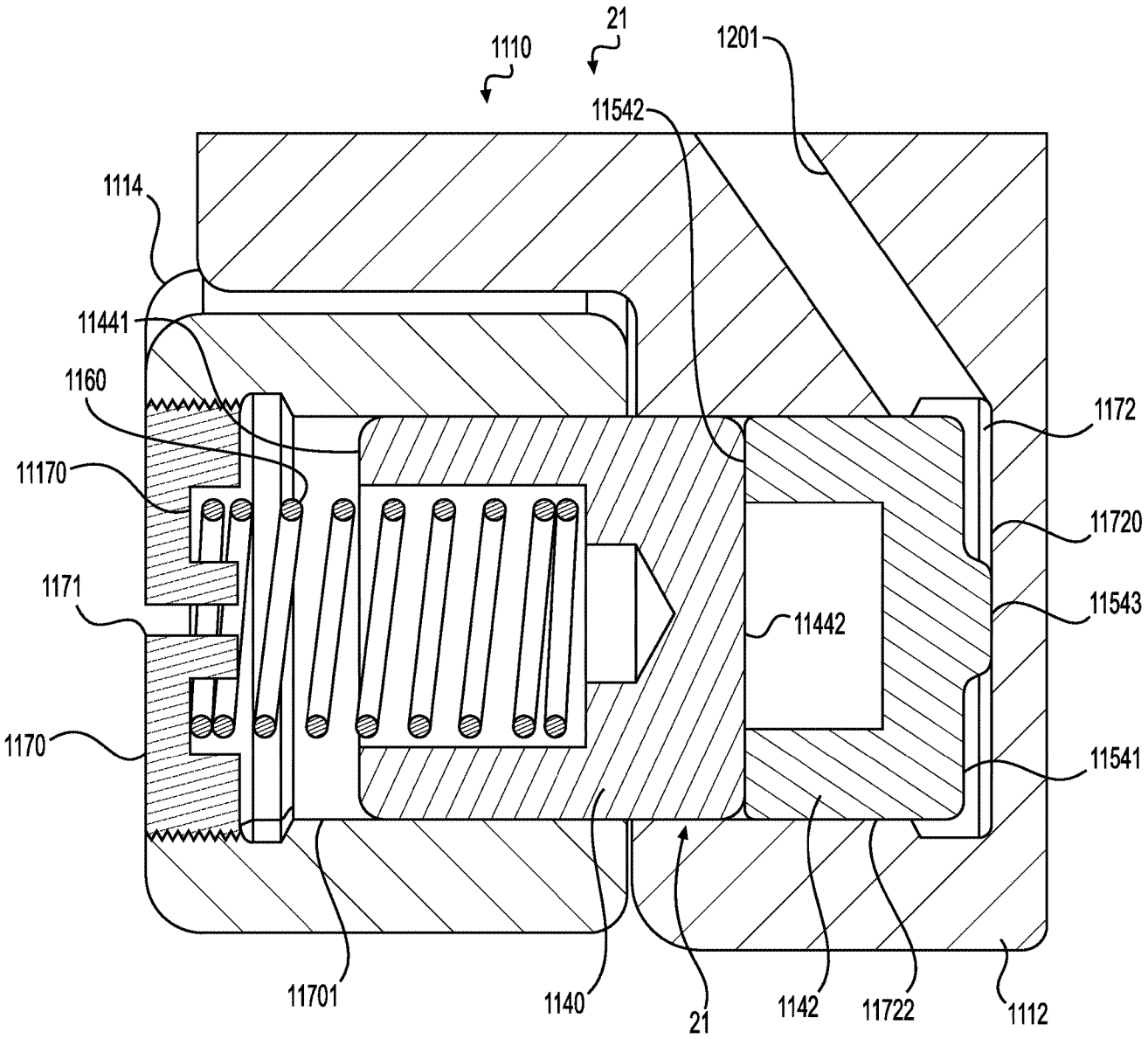
FIGS. 14-18 are examples of self-retracting latches.

In FIGS. 13 & 14, latch pin assembly 21 will be described. Outward surface of second end 1142 of primary latch pin assembly 1140 can be biased towards secondary latch pin assembly 1142 by first biasing member 1160. Outward surface of second end 11542 of secondary latch pin assembly 1142 can be biased towards primary latch pin assembly 140 by oil pressure from oil port 1201 from rocker shaft bore 3 to a gland communicating with secondary oil control cavity 1172. Primary latch pin assembly 1140 is arranged to telescope in and out of primary channel 11701 in response to spring force from first biasing member 1160 or opposing pressure from secondary latch pin assembly 1142 and oil pressure to oil channel 1201. Secondary latch pin assembly 1142 can telescope in and out of secondary channel 11722 of secondary oil control cavity 1172 by being pushed by first biasing member 1160 or by the oil pressure to oil channel 1201.

A first end 1441 of primary latch pin assembly 1140 can abut an inner surface of plug 1170 when oil pressure is applied through oil port 1201 in the unlatched position of latch pin assembly 21. In the unlatched position, lift forces from cam 2 get lost, because the cam side arm 1114 can move without transferring forces to the valve side arm 1112. However, in the latched position, the latch pin assembly 21 locks the cam side arm 1114 and valve side arm 1112 together so that lift forces from the cam 2 are transferred to the valve end 4 of the rocker arm 1110.

First biasing member 1160 can be seated against a seat 11170 in plug 1170 to push the primary latch pin assembly 1140 towards the latched position. The latched position comprises the primary latch pin assembly 1140 extending from primary channel 11701 into secondary channel 11722. A relief port 1171 in plug 1170 can serve as a wrench coupling for threading the plug 1170 to threads in primary channel 11701. Relief port 1171 can also emit oil that leaks through the latch pin assembly, as from valve side latch bore to cam side latch bore.

To enter the unlatched position, oil port 1201 communicates with oil control cavity 1172 for providing oil pressure to selectively push secondary latch pin assembly 1142 away from back wall 11720 of oil control cavity 1172. First end 11541 of secondary latch pin assembly 1142 can be configured with a knurl 11543 to space the first end 11541 away from the back wall 11720, which can help with stiction. The knurl 11543 serves as a stop feature and it allows oil to engage the first end 11541 of the secondary latch pin assembly 1142 in a way that improves the response time and avoids gage blocking. Oil pressure pushes the secondary latch pin assembly 1142 towards the cam side arm 1114 so that primary latch pin assembly 1140 slides out of secondary channel 11722 and through primary channel 11701. The first biasing member 1160 can be compressed. With enough force, first end 11441 of primary latch pin assembly 1140 can abut plug 1170.

The latch pin assembly 21 offers several advantages. For example, it is possible to align the cam side arm 114 with the valve side arm 1112 and drill both bores for the latch pin assembly 21 at the same time. Then, concentricity is assured for the channels 11701 & 11722. The pieces of the latch pin assembly 21 are assured to align, and a drop-in assembly method can be achieved. Also, lash can be set during the drilling process. This can avoid critical shifts. And, the plug 1170 can be threaded or otherwise set in the cam side latch bore to a depth that sets the travel of primary latch pin assembly 1140 while the relief port 1171 in the plug 1170 provides an additional pathway for overpressure release. The threaded plug 1170 provides an adjustment capability for the primary latch pin 1140 so that when the primary latch pin 1140 is retracted into channel 11701, the gap of distance D1 is preserved.

Even with the advantages of the latch pin assembly 21, it is beneficial to add additional and optional features in the alternative, as seen in latch pin assembly 22. By looking at the simplified assembly of FIG. 13, it can be seen that the primary latch pin assembly 1140 can tilt in the channels 11701 & 11722. This can create contact stress zones Z1, Z2, Z3, Z4. It is desirable to alleviate the contact stresses, and so turning to FIGS. 15 & 16, options are shown for reducing the contact stresses. Options for including and improving self-retracting features are also discussed by comparing FIGS. 14-16.

Figure 15:
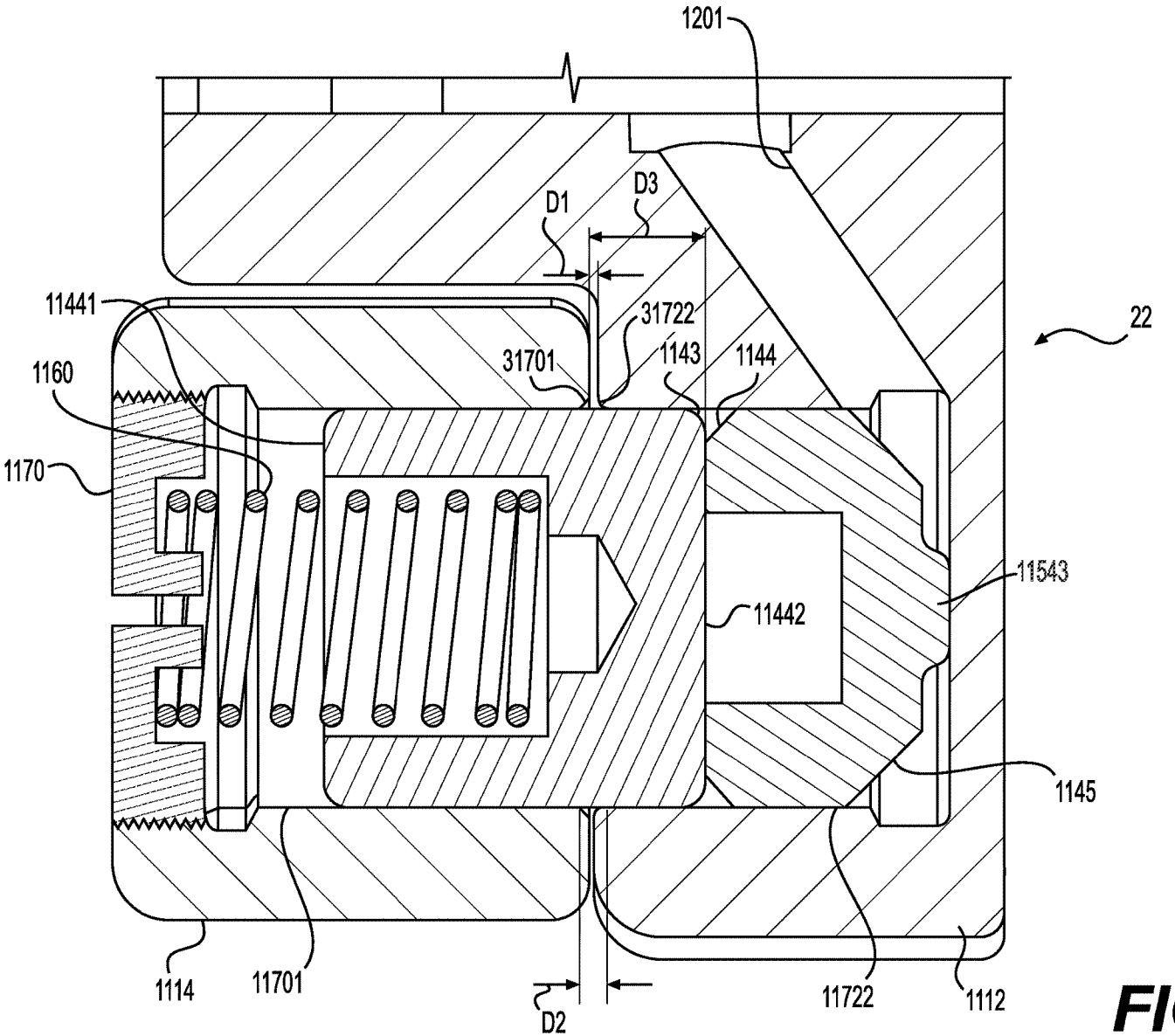
Figure 16:
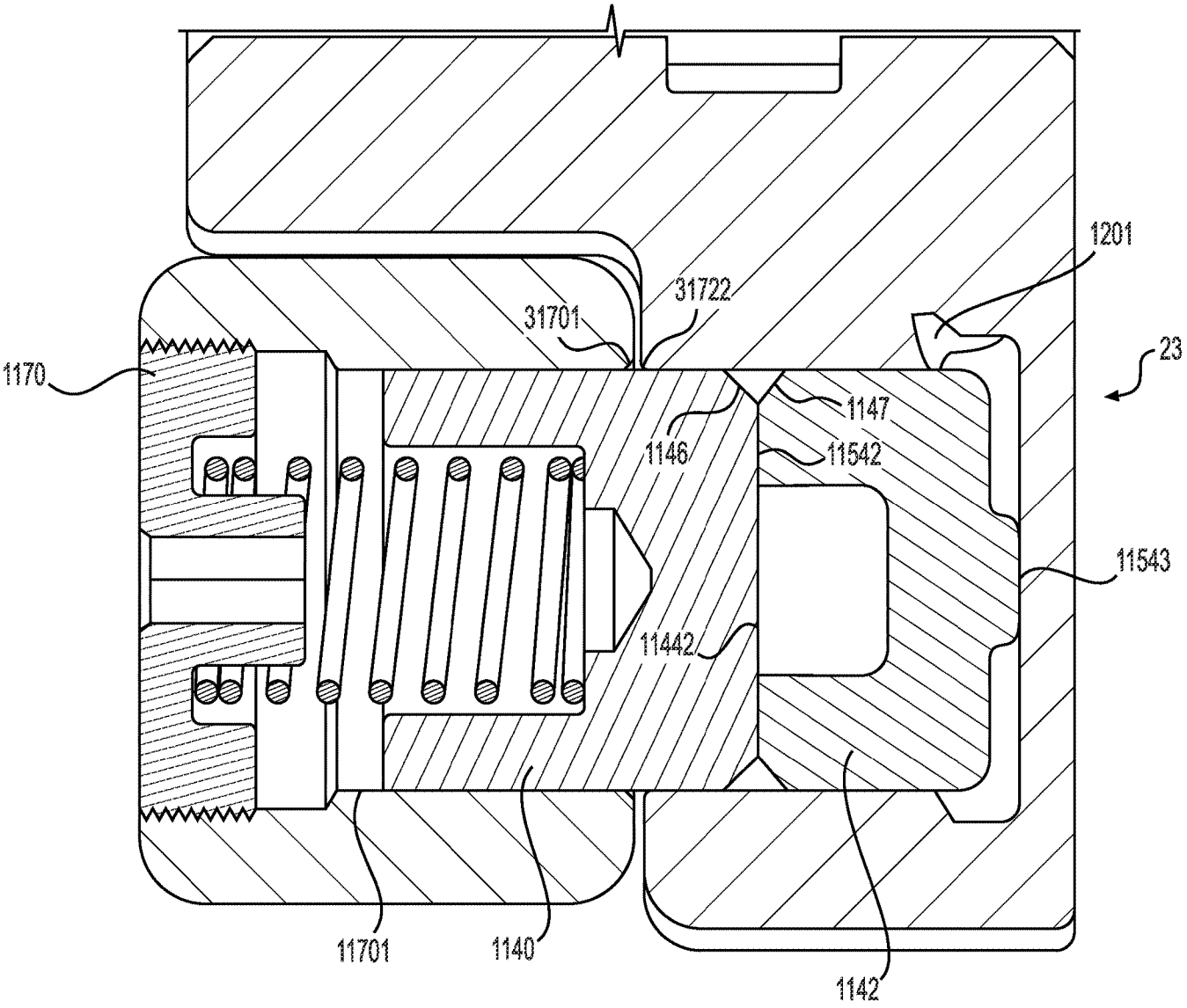
Figure 18:
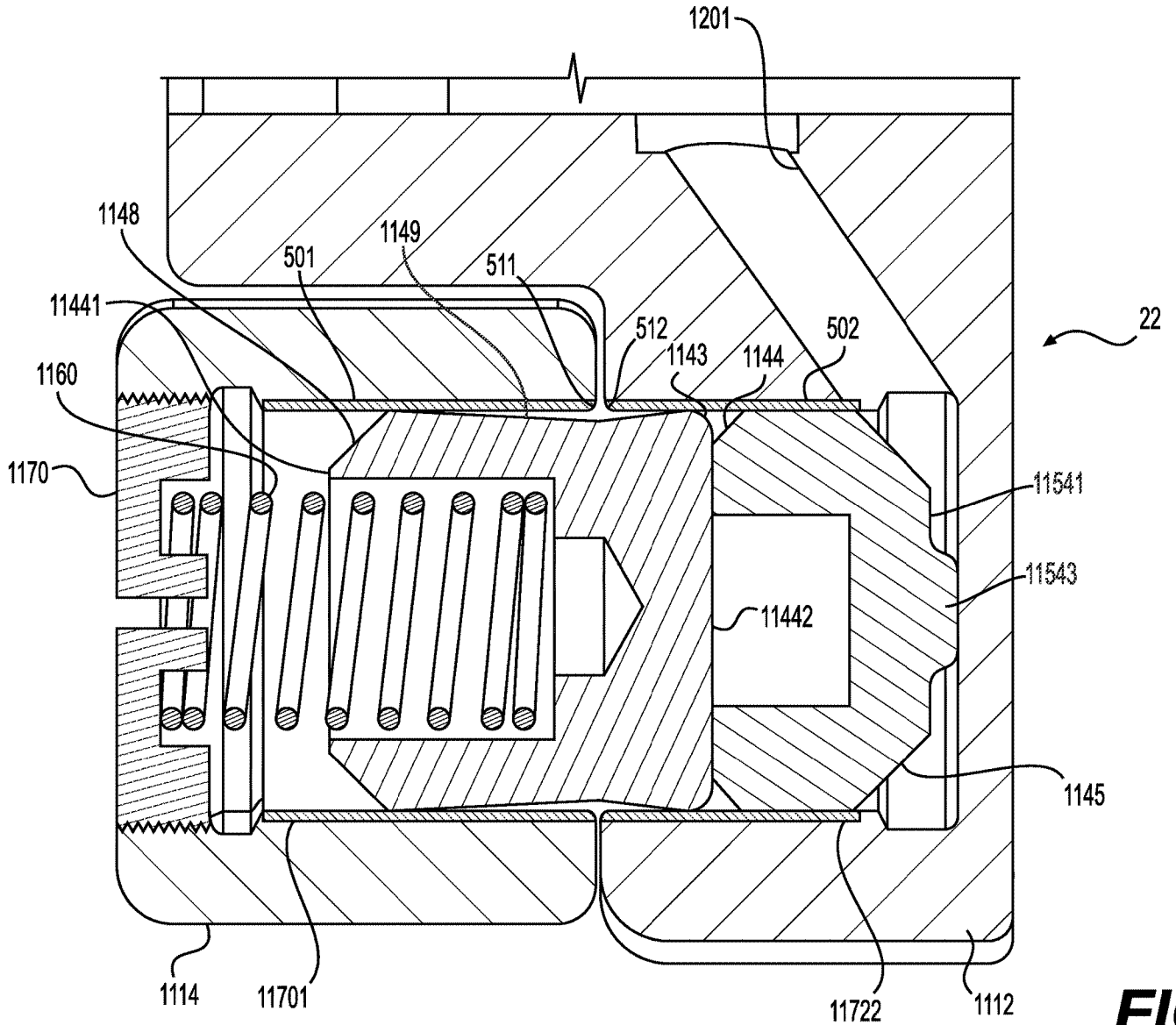

The second end 11442 of primary latch pin assembly 1140 can include an edge feature 1143, 1146 that helps with the releasing and returning of the primary latch pin assembly 1140 to the latch pin bore of the cam side arm 1114 during the no lift, deactivated state of the unlatched latch pin assembly 21, 22. The edge feature can comprise, for example, a radius, a chamfer, a bevel, a fillet, a round over, a bullnose, or the like. The edge feature is configured to reduce contact stresses. This can include minimizing edge-loading on the latch pin assembly 1140, 1142 as tilting occurs in the corresponding latch bores. That is, as the cam 2 transfers its profile to the cam side arm 1114, the latch assembly can tilt in the cam side latch bore and in the valve side latch bore, and the edge features 1143-1149 can reduce edge loading and other contact stresses on the latch assembly and latch bores. The primary latch pin assembly 1140 can be a pin with a cylindrical shape, and so a round over can be applied at the whole edge of the second end 11442. The pin is not limited to a cylindrical shape. Then, when a channel edge 31722 of secondary channel 11722 presses on the edge feature 1143, 1146, the channel edge 31722 can push the primary latch pin assembly 1140 into primary channel 11701 so that the cam side arm 1114 can pivot with respect to the valve side arm 1112 while the latch pin assembly 21 is unlatched. The channel edge 31722 can comprise a complementary shape, such as a chamfer or radius to act on a chamfer or radius edge feature. In FIG. 15, a chamfer is the edge feature 1144 while a radius is the channel edge 31701. But in FIG. 16, a radius is the edge feature 1147 while a chamfer is the channel edge 31701. In FIG. 15, the edge feature 1143 is a radius while the channel edge 31722 is also a radius. In FIG. 16, the edge feature 1146 is a chamfer while the channel edge 31722 can be a radius or slight chamfer. The figures are not exhaustive of the possible combinations and other combinations are contemplated. Further reductions in contact stress and edge loading can be achieved by adding an edge feature 1148 to the first end 11441 of the primary latch pin assembly 1140 so that when the primary latch pin assembly 1140 tilts in the primary channel 11701, contact stress is reduced. As shown in FIG. 18, an edge feature 1149 can be added around the outer surface. Instead of a true cylinder, the primary latch pin is hourglass-shaped for a portion of the outer diameter by way of the wedge-shaped outer surface. The edge feature 1149 can comprise two angles to form a wedge or V-shaped outer diameter. Now, if the primary latch pin assembly 1140 tilts like in FIG. 13, the contact stresses can be reduced on one or more of surface of primary latch pin 1140. Such wedge shape can be added to the other embodiments. By adding the self-retracting features, including edge features and channel edges, there is less chance of a critical shift or partial valve engagement, or other failures of the valves to be positioned correctly relative to the cylinder head when the piston is reaching top dead center in the cylinder.

Additional edge features can be included, as shown in FIG. 15. The rounded edge feature 1143 can be combined with a chamfer edge feature 1144 on the secondary latch pin 1142. Then, channel edge 31701 of primary latch pin primary channel 11701 could be a radius configured to push on and slide past the chamfer edge feature 1144 thereby assisting with the return of secondary latch pin 1142 into secondary channel 11722. As with the edge feature, the channel edges can comprise shapes other than radius and chamfer, such as bevel, fillet, bullnose, round over, or the like.

A gap of distance D1 can be set between the cam side arm 1114 and the valve side arm 1112. Primary latch pin 1140 projects into secondary channel 11722 a distance D3 during latching. Then, a distance D2 can be designed to enable the self-retracting features. So long as the secondary latch pin 1145 can supply oil pressure to push the primary latch pin 1140 to a reset zone of distance D2 overlapping the gap of distance D1 between the cam side arm 114 and the valve side arm 1112, then the channel edge 31701 can push the secondary latch pin 1145 out of the way and the channel edge 31722 can push the primary latch pin 1140 out of the way for unlatched (lost motion). The primary latch pin 1140 can project into secondary channel 11722 but can self-retract via the edge feature 1143. Likewise, the secondary latch pin 1145 can project into the primary channel 11701 but can self-retract via the edge feature 1144. It can be said that the primary latch pin assembly 1140 can be configured to project into the valve side arm 1112 within a reset zone. The reset zone can be a second distance greater than the first distance D1. This second distance can be a subset of distance D2. Channel edge 31722 on the valve side arm 1112 can be configured to act on an edge feature 1143 on the primary latch pin assembly to retract the primary latch pin 1140 into the cam side latch bore comprising primary channel 11701. Likewise, secondary latch pin 1145 can be configured to project into cam side arm 1114 within a reset zone. This reset zone can likewise be a distance that is a subset of distance D2. So, the latch pin assembly can retract by the forces of rotation of the rocker arm assembly.

On the first end 11541 of secondary latch pin 1142, one or more additional edge features 1145 can be included for light weighting, alleviating strain, or improving oil pressure control.

Figure 17:
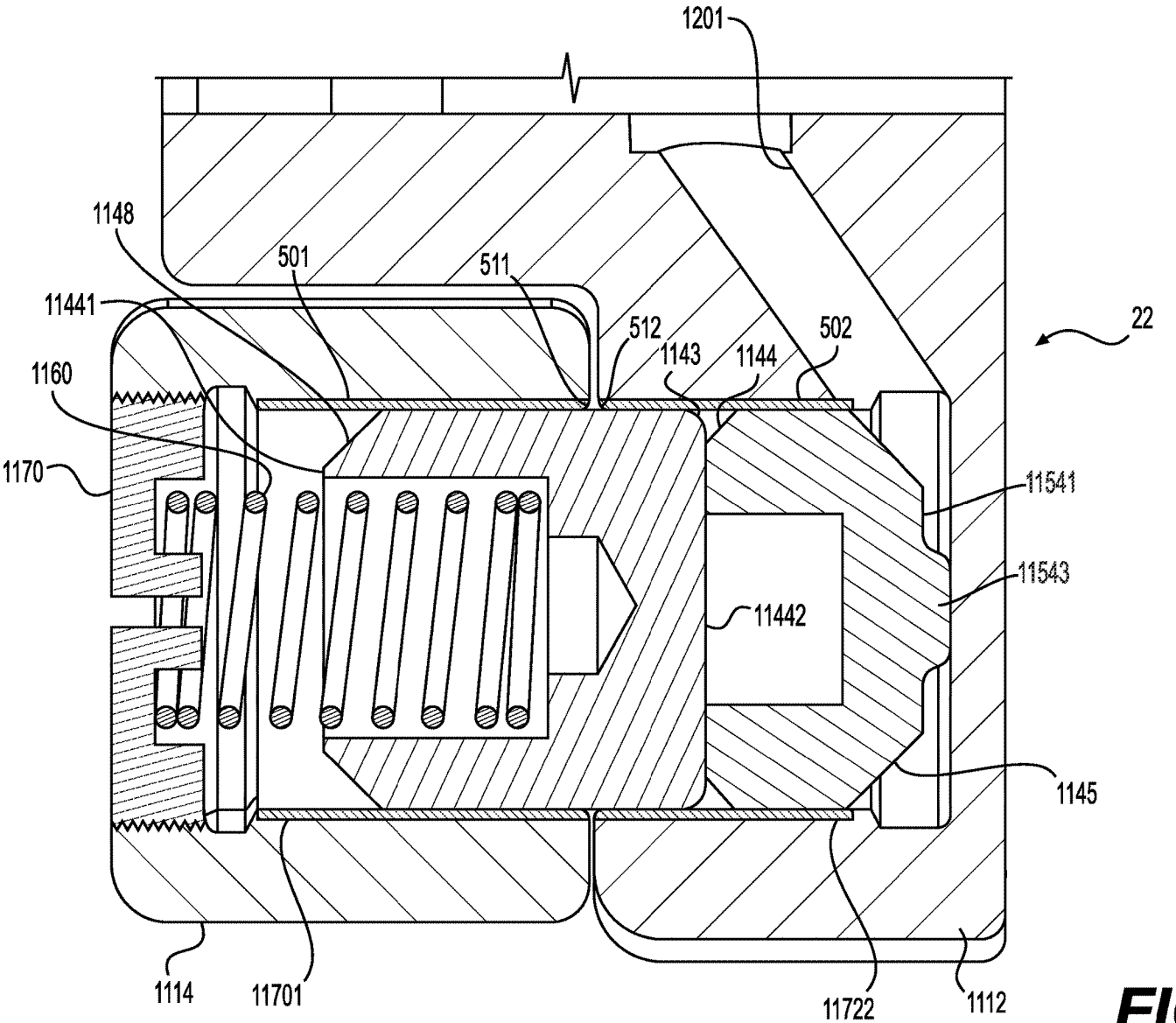

Turning to FIG. 17, another aspect of the self-retracting latch can be seen. The channels 11701 & 11722 are fitted with inserts 501, 502. The inserts can be hardened steel or another hard material that withstands contact stresses. The inserts 501, 502 can be placed where contact stress zones Z1, Z2, Z3, Z4 would occur. Similar to a bushing or other bearing surface, the inserts can be pressed in place after the channels 11701, 11722 are formed. Channel edges 31701 & 31722 are replaced with insert edges 511, 512. The shapes enumerated above, such as a radius, a chamfer, a bevel, a fillet, a round over, a bullnose, or the like, can be applied to the insert edges 511, 512 so that when the insert edges 511, 512 press on edge features 1143, 1144, the latch retracts as explained above. The inserts 501, 502 can improve wear resistance. An additional manufacturing benefit can be achieved. While it is possible to manufacture the cam side arm 14, 114, 1114 and the valve side arm 12, 112, 1112 out of a hard material, or a material that is hardened after machining steps are completed, it is possible to use a softer material or remove the hardening step by including the inserts 501, 502 as the hard or hardened material.

Other implementations will be apparent to those skilled in the art. The foregoing description is not intended to be exhaustive. Individual elements or features of a particular example are not exclusive to that particular example, but, where applicable, are interchangeable and can be used in other examples disclosed. For example the retracting features of FIGS. 13-17 can be combined with the latches of FIGS. 3-5 & 7-12. As another example, the hardened inserts 501, 502 can be included in any of the latches disclosed. As yet another example, the method of machining both the cam side channel and the valve side channel at the same time can be applied to any of the embodiments.

What is claimed is:

1. A rocker arm assembly comprising:

a cam side rocker arm portion configured to selectively rotate about a pivot location, the cam side rocker arm portion comprising:
- a first socket above the pivot location; and
- a cam end configured to receive a lift profile from a cam lobe;

a valve side rocker arm portion configured to rotate about the pivot location relative to the cam side rocker arm portion, the valve side rocker arm portion comprising:
- a rocker shaft bore;
- a second socket above the pivot location; and
- a valve side latch body below the rocker shaft bore;

a pivot axle joining the cam side rocker arm portion to the valve side rocker arm portion at the pivot location, the pivot axle being located between the cam end and the first socket at a position adjacent the rocker shaft bore; and a lost motion spring spanning between the first socket and the second socket.

2. The rocker arm assembly of claim 1, wherein the first socket forms a ball-and-socket arrangement with a first end of the lost motion spring.

3. The rocker arm assembly of claim 2, wherein the first socket comprises a spring guide comprising one of a stake or a stepped surface.

4. The rocker arm assembly of claim 1, wherein the second socket forms a ball-and-socket arrangement with a second end of the lost motion spring.

5. The rocker arm assembly of claim 1, further comprising a first positioning pin in the first socket, a first end of the lost motion spring positioned on the first positioning pin.

6. The rocker arm assembly of claim 5, further comprising a second positioning pin in the second socket, a second end of the lost motion spring positioned on the second positioning pin.

7. The rocker arm assembly of claim 5, wherein the first positioning pin comprises a rounded surface configured to interface with the first socket in a ball-and-socket arrangement.

8. The rocker arm assembly of claim 5, wherein the first positioning pin comprises a spring guide comprising one of a stake or a stepped surface.

9. The rocker arm assembly of claim 1, wherein the cam side rocker arm portion further comprises a first knurl protruding away from the pivot location, and wherein the first socket is formed in the first knurl.

10. The rocker arm assembly of claim 9, wherein the valve side rocker arm portion further comprises a second knurl protruding away from the pivot location, and wherein the second socket is formed in the second knurl.

11. The rocker arm assembly of claim 10, wherein the cam side rocker arm portion further comprises a body portion configured to at least partially encircle a rocker shaft adjacent the rocker shaft bore.

12. A rocker arm assembly, comprising:

a cam side rocker arm configured to rotate about a pivot location, the cam side rocker arm comprising a cam end, a cam side latch body extending away from the cam end, and a first socket extending away from the cam end;

a valve side rocker arm configured to rotate about the pivot location, the valve side rocker arm comprising a second socket extending away from the pivot location, a valve side latch body extending away from the pivot location, a rocker shaft bore above the valve side latch body, and a valve end extending away from the pivot location;

a pivot axle joining the cam side rocker arm to the valve side rocker arm at the pivot location, the pivot axle being located between the cam end and the first socket at a position adjacent the rocker shaft bore; and a lost motion spring pressed between the first socket and the second socket, the lost motion spring comprising a first end in a ball-and-socket arrangement with the first socket, and a second end in a ball-and-socket arrangement with the second socket.

13. A rocker arm assembly comprising:

a cam side rocker arm portion configured to selectively rotate about a pivot location, the cam side rocker arm portion comprising:

a body portion;

a first knurl protruding away from the pivot location;

a first socket above the pivot location, the first socket formed in the first knurl; and a cam end configured to receive a lift profile from a cam lobe;

a valve side rocker arm portion configured to rotate about the pivot location relative to the cam side rocker arm portion, the valve side rocker arm portion comprising:

a rocker shaft bore a second knurl protruding away from the pivot location; and a second socket above the pivot location, the second socket formed in the second knurl; and a lost motion spring pressed between the first socket and the second socket, wherein the body portion is configured to at least partially encircle a rocker shaft adjacent the rocker shaft bore.

14. The rocker arm assembly of claim 13, wherein the pivot location comprises a pivot axle joining the cam side rocker arm portion to the valve side rocker arm portion.

15. The rocker arm assembly of claim 14, wherein the pivot axle is above the cam end.

16. The rocker arm assembly of claim 15, wherein the cam side rocker arm portion further comprises a cam side latch body adjacent the cam end.

17. The rocker arm assembly of claim 14, wherein the pivot axle is between the cam end and the first socket.

18. The rocker arm assembly of claim 17, wherein the pivot axle is adjacent the rocker shaft bore.

19. The rocker arm assembly of claim 18, wherein the valve side rocker arm portion further comprises a valve side latch body below the rocker shaft bore.

20. The rocker arm assembly of claim 18, wherein the valve side rocker arm portion further comprises a valve side latch body adjacent the cam end.

* * * * *